US011913092B2

(12) United States Patent
Hong et al.

(10) Patent No.: US 11,913,092 B2
(45) Date of Patent: Feb. 27, 2024

(54) MAGNESIUM-BASED ALLOY FOAM

(71) Applicant: CellMo Materials Innovation, Inc., Berkeley, CA (US)

(72) Inventors: Kicheol Hong, Busan (KR); Hyeji Park, Seoul (KR); Teakyung Um, Seoul (KR); Heeman Choe, Walnut Creek, CA (US)

(73) Assignee: CellMo Materials Innovation, Inc., Berkeley, CA (US)

( * ) Notice: Subject to any disclaimer, the term of this patent is extended or adjusted under 35 U.S.C. 154(b) by 0 days.

(21) Appl. No.: 17/258,136

(22) PCT Filed: Jul. 8, 2019

(86) PCT No.: PCT/US2019/040894

§ 371 (c)(1),
(2) Date: Jan. 5, 2021

(87) PCT Pub. No.: WO2020/010362

PCT Pub. Date: Jan. 9, 2020

(65) Prior Publication Data

US 2021/0277503 A1 Sep. 9, 2021

Related U.S. Application Data

(60) Provisional application No. 62/694,953, filed on Jul. 6, 2018.

(51) Int. Cl.

| | |
|---|---|
| ***B22F 3/22*** | (2006.01) |
| ***B22F 1/06*** | (2022.01) |
| ***B22F 1/10*** | (2022.01) |
| ***B22F 3/10*** | (2006.01) |

(Continued)

(52) U.S. Cl.

CPC ..... *C22C 1/08* (2013.01); *B22F 1/06* (2022.01); *B22F 1/10* (2022.01); *B22F 3/11* (2013.01);

(Continued)

(58) Field of Classification Search

CPC . B22F 3/222; B22F 2301/058; B22F 2303/05

See application file for complete search history.

(56) References Cited

U.S. PATENT DOCUMENTS

| | | | |
|---|---|---|---|
| 2015/0072236 | A1 | 3/2015 | Um et al. |
| 2017/0021416 | A1 | 1/2017 | Park et al. |
| 2017/0025683 | A1 | 1/2017 | Park et al. |

FOREIGN PATENT DOCUMENTS

| | | | |
|---|---|---|---|
| CN | 1936045 A | * | 3/2007 |
| CN | 1936045 A | | 3/2007 |

(Continued)

OTHER PUBLICATIONS

KR-101311273-B1 English language translation (Year: 2013).*

(Continued)

*Primary Examiner* — Sally A Merkling
*Assistant Examiner* — Sean P. O'Keefe
(74) *Attorney, Agent, or Firm* — Aka Chan LLP

(57) ABSTRACT

Morphology, microstructure, compressive behavior, and biocorrosive properties of magnesium or magnesium alloy foams allow for their use in biodegradable biomedical, metal-air battery electrode, hydrogen storage, and light-weight transportation applications. Magnesium or Mg alloy foams are usually very difficult to manufacture due to the strong oxidation layer around the metallic particles; however, in this invention, they can be synthesized via a camphene-based freeze-casting process with the addition of graphite powder using precisely controlled heat-treatment parameters. The average porosity ranges from 45 to 85 percent and the median pore diameter is about a few tens to hundreds of microns, which are suitable for bio and energy applications utilizing their enhanced surface area. This invention based on powder-slurry freeze-casting method using camphene as a volatile solvent is also applicable for (Continued)

other metal foams such as iron, copper, or others to produce three-dimensional metal foams with high strut connectivity.

9 Claims, 20 Drawing Sheets

(51) Int. Cl.

| | |
|---|---|
| ***B22F 3/11*** | (2006.01) |
| ***C22C 1/08*** | (2006.01) |
| ***C22C 23/00*** | (2006.01) |
| ***C22C 23/02*** | (2006.01) |
| ***C22C 23/04*** | (2006.01) |
| ***C22C 23/06*** | (2006.01) |

(52) U.S. Cl.
CPC ..... *B22F 3/222* (2013.01); *C22C 23/00* (2013.01); *C22C 23/02* (2013.01); *C22C 23/04* (2013.01); *C22C 23/06* (2013.01); *B22F 3/10* (2013.01); *B22F 2202/01* (2013.01); *B22F 2301/058* (2013.01); *B22F 2998/10* (2013.01); *C22C 1/087* (2023.01)

(56) References Cited

FOREIGN PATENT DOCUMENTS

| | | | | | |
|---|---|---|---|---|---|
| CN | 104689368 | A | | 6/2015 | |
| CN | 107115560 | A | * | 9/2017 | ..... A61L 27/06 |
| CN | 107115560 | A | | 9/2017 | |
| EP | 356462 | B1 | * | 9/1993 | ..... B22F 3/22 |
| GB | 2163780 | A | * | 3/1986 | ..... B22F 1/0059 |
| KR | 101311273 | B1 | * | 9/2013 | |
| KR | 101311273 | B1 | | 9/2013 | |

OTHER PUBLICATIONS

CN-107115560-A English language translation (Year: 2017).*
CN-1936045-A English language translation (Year: 2007).*
Deprez, N., and D. S. McLachlan. "The analysis of the electrical conductivity of graphite conductivity of graphite powders during compaction." Journal of Physics D: Applied Physics 21.1 (1988): 101. (Year: 1988).*
Neu et al., Magnesium and Magnesium Alloy Foams, 7th International Conference on Porous Metals and Metallic Forms, MetFoam 2011, Jan. 31, 2011, p. 133, 8 pages.
Gupta et al., Magnesium Matrix Composite Foams-Density, Mechanical Properties, and Applications. Jul. 24, 2012, pp. 238-252, 15 pages, Metals 2012, No. 2.3.
Gaudillere et al., Freeze-casting: Fabrication of highly porous and hierarchical ceramic supports for energy applications, Boletin de la Sociedad Española de Ceramica y Vidrio (Bulletin of the Spanish Society of Ceramics and Glass), Mar. 4, 2016, pp. 45-54, 10 pages, vol. 55, Issue 2, Elsevier España, S.L.U, Valencia, Spain.
International Search Report, PCT Application PCT/US2019/040894, dated Oct. 10, 2019, 5 pages.

* cited by examiner

MAGNESIUM-BASED ALLOY FOAM

CROSS-REFERENCE TO RELATED APPLICATIONS

This patent application claims the benefit U.S. patent application 62/694,953, filed Jul. 6, 2018, which is incorporated by reference along with all other references cited in this

BACKGROUND OF THE INVENTION

Recently, magnesium-based alloys and composites have been widely used for numerous application areas such as medical (e.g., implants and stents), transportation (e.g., automobile and aerospace) and energy (e.g., battery and hydrogen storage) because they possess the required outstanding intrinsic properties, including good biocompatibility, high specific strength, and high electrochemical reactivity.

More interestingly, the biocompatibility of magnesium-based materials is superior to that of other metallic biomaterials (e.g., stainless steels, titanium alloys, cobalt-chromium-based alloys, or others) for several reasons. First, $Mg^{2+}$ (formed via corrosion) is important for metabolism and beneficial for osteogenesis. Second, the elastic modulus of magnesium (41-45 gigapascals) is much closer to that of human cortical bone (e.g., about 3-20 gigapascals) than conventional metallic biomaterials (e.g., about 115-230 gigapascals for stainless steels, titanium alloys, and cobalt-chromium-based alloys). As the conventional metallic biomaterials have much higher elastic modulus than human bone, they can potentially result in gradual bone degradation with long usage. Therefore, magnesium-based materials are highly attractive for biomedical application especially for orthopedic devices such as bone implants, screws, and graft substitutes.

Several advantages were recently reported for porous magnesium-based materials (or magnesium-based foams) for their particular use in bone tissue applications owing to their enhanced surface area for the ingrowth of tissues and nutrient transportation as well as adjustable mechanical properties (e.g., Young's modulus), which can make them even more similar to bone.

Though magnesium or magnesium-based alloy foams are extremely difficult to manufacture due to their inherently aggressive reactivity, they can be manufactured using only certain complex methods, such as space-holders, vacuum foaming, or investment casting.

On the other hand, freeze casting is a highly promising method for manufacturing magnesium-based foams with better controllability for morphology, because this method essentially produces replicated foams via a combination of low-temperature solvent drying and high-temperature powder sintering. However, there are a few problems to overcome for the successful fabrication of magnesium-based foams via conventional freeze casting based on water solvent. The starting magnesium powder would spontaneously react with water, resulting in the generation of hydrogen gas through hydrolysis. Moreover, considering that powder sintering is an important processing step for freeze casting, the extremely poor sinterability of magnesium powder caused by the presence of its native oxide layer prevents sintering of the green-body foam structure. To overcome these problems, we invented the use of a camphene solvent, which is relatively nonreactive to magnesium, leading to a stable suspension preparation. Additionally, we invented the use of graphite powder as a buffer during sintering to prevent additional oxidation; here, the sintering step should be conducted at a temperature close to the melting point of magnesium to weaken the native oxide layer.

This invention demonstrates for the first time the successful manufacture of magnesium or magnesium-based alloy foams using a camphene-based freeze casting method. An example material we demonstrate in this invention is AE42 magnesium alloy foam containing a few alloying elements such as aluminum and rare-earth elements.

BRIEF SUMMARY OF THE INVENTION

The unique morphology, microstructure, compressive behavior and biocorrosive properties of magnesium or magnesium alloy foams allow for their potential use in biodegradable biomedical, metal-air battery electrode, hydrogen storage, lightweight transportation applications. Although conventional water-based freeze casting may be a promising method for manufacturing metallic foams with better controllability for morphology, it is very difficult to produce magnesium or magnesium alloy foams due to its strong reactivity with water. In this invention, we successfully produced magnesium-based foams using a combination of low-temperature camphene solvent drying and high-temperature powder sintering. Magnesium alloy foams can be synthesized via a camphene-based freeze-casting process with precisely controlled heat treatment parameters. While the average porosity of the example magnesium alloy foam we produced is approximately 52 percent and the median pore diameter is about 13 microns, the porosity and pore size of the magnesium or magnesium alloy foam produced by this invention range from 45 to 85 percent and 1 micrometer to 300 microns, respectively.

Salient deformation mechanisms and associated mechanical reliability can be identified using acoustic emission (AE) signals and adaptive sequential k-means (ASK) analysis. Twinning, dislocation slip, strut bending, and collapse are dominant during compressive deformation. Nonetheless, the overall compressive behavior and deformation mechanisms were similar to those of bulk magnesium based on ASK analysis. The corrosion potential of the magnesium alloy scaffold (−1.442 volts) was slightly higher than that of pure bulk magnesium (−1.563 volts) owing to the inherent benefits of alloying. However, the corrosion rate of the magnesium alloy foam was faster than that of bulk pure magnesium due to the enhanced surface area of the magnesium alloy foam compared with that of the pure magnesium. Overall, the magnesium alloy scaffold showed acceptable biocompatibility in comparison with the bulk pure magnesium.

Other objects, features, and advantages of the present invention will become apparent upon consideration of the following detailed description and the accompanying drawings, in which like reference designations represent like features throughout the figures.

BRIEF DESCRIPTION OF THE DRAWINGS

FIGS. 11A-11D show (11A) schematic illustration of the facilities for electrochemical measurement in the simulated in-vivo condition; (11B) comparison of the potentiodynamic polarization curves of pure magnesium and AE42 foams after 24 hours of immersion; evolution of EIS plots of (11C) pure magnesium and (11D) AE42 alloy foams after 2, 6, 12, and 24 hours of immersion.

DETAILED DESCRIPTION OF THE INVENTION

Figure 1:
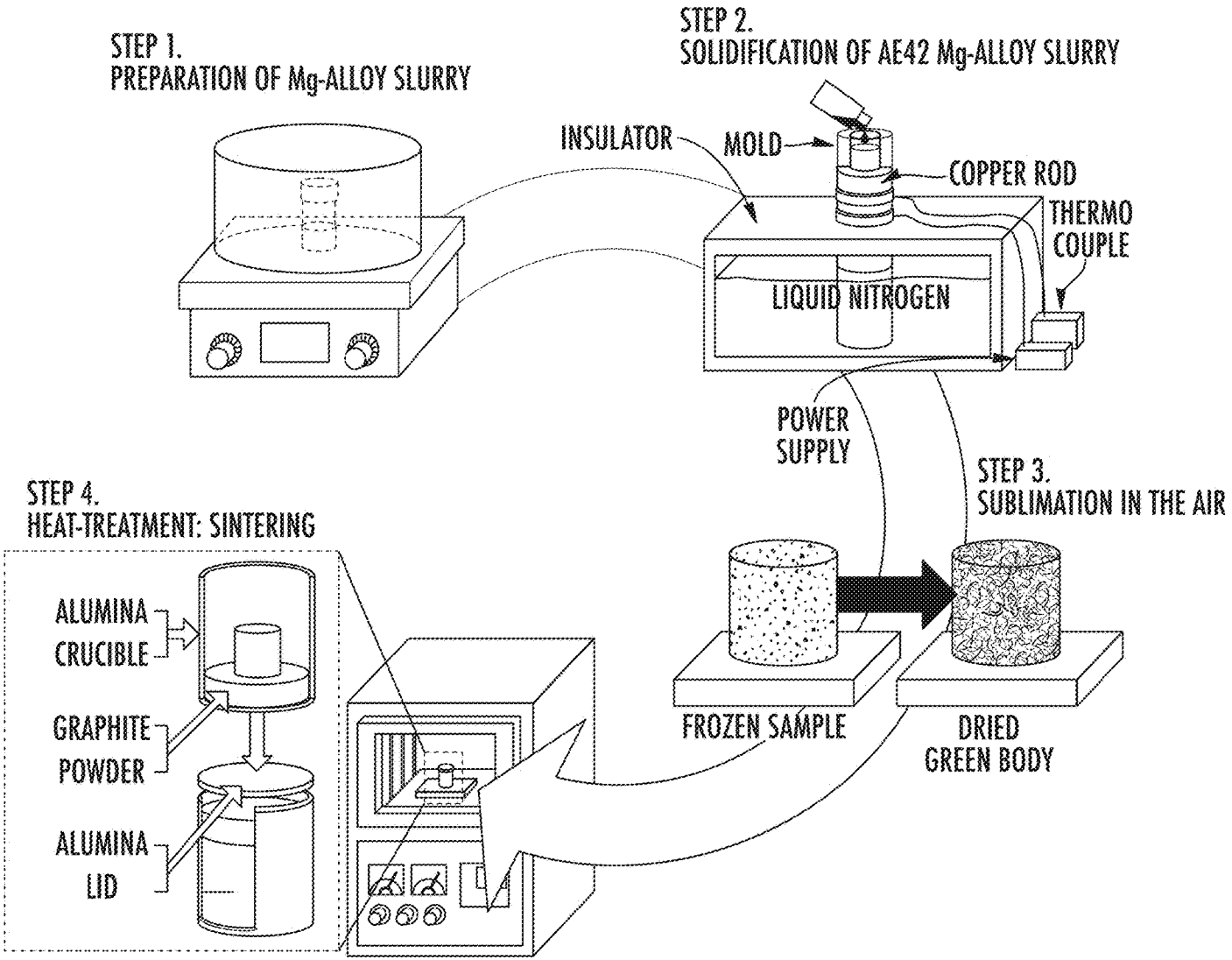
FIG. 1 shows a flow for the fabrication of AE42 magnesium alloy foams.

Magnesium-based alloys and composites have been widely used for a number of industrial applications such as medical (e.g., implants and stents), transportation (e.g., automobile and aerospace) and energy (e.g., battery and hydrogen storage) areas, because they possess the required outstanding intrinsic properties, including good biocompatibility, high specific strength, and high electrochemical reactivity.

In particular, the biocompatibility of magnesium-based materials is superior to that of other metallic biomaterials (e.g., stainless steels, titanium alloys, cobalt-chromium-based alloys, and others) for several reasons. First, ionized magnesium ($Mg^{2+}$) (formed via in-vivo corrosion) is important for metabolism and beneficial for osteogenesis. Second, the compressive yield strength (65-100 megapascals) and elastic modulus (41-45 gigapascals) of pure magnesium are similar to those of human bone (130-180 megapascals and 3-20 gigapascals, respectively), resulting in the reduction of the stress-shield effect when magnesium is used as an implant material. Other comparable metallic biomaterials have much higher elastic modulus than human bone, leading to gradual bone degradation with long usage. Therefore, magnesium-based materials are highly attractive for use in biomedical implants and devices, especially for orthopedic devices such as bone implants, screws, and graft substitutes.

Several advantages for porous magnesium-based materials (or magnesium-based foams) in their particular use in bone tissue applications are identified owing to their enhanced surface area for the ingrowth of tissues and nutrient transportation as well as adjustable mechanical properties (e.g., Young's modulus), which can make them even more similar to bone. Though magnesium-based foams are extremely difficult to manufacture due to their inherently aggressive reactivity, a freeze-casting method based on camphene solvent with the use of graphite powder enables the manufacture of magnesium foams via a combination of low-temperature camphene solvent drying and high-temperature powder sintering. Additionally, freeze casting has exceptional advantages such as low cost, less harm to the environment, and precisely controllable morphology by adjusting major processing parameters.

It is particularly noted that the conventional water-based freeze casting makes it highly difficult to produce decent magnesium foams due to its strong reactivity with water. If water is used as in most cases for the freeze casting process, the starting magnesium powder would spontaneously react with water, resulting in the generation of hydrogen gas through hydrolysis. See equations 1 in table A below.

TABLE A

| Equations 1 |
|---|
| $2Mg \rightarrow 2Mg^{+} + 2e^{-}$ |
| $2Mg^{+} + 2H_2O \rightarrow 2Mg^{2+} + 2OH^{-} + H_2$ |
| $2H_2O + 2e^{-} \rightarrow H_2 + 2OH^{-}$ |
| $2Mg^{2+} + 4OH^{-} \rightarrow 2Mg(OH)_2$ |
| $MgO + H2O \leftrightarrow Mg(OH)_2$ |

Moreover, considering that powder sintering is an important processing step for freeze casting, the extremely poor sinterability of magnesium powder caused by the presence of its native oxide layer prevents sintering of the green-body foam. To overcome these problems in this invention, we used a camphene solvent, which is relatively nonreactive to magnesium, leading to a stable suspension preparation. We also used graphite powder as a buffer during sintering to prevent additional oxidation; here, the sintering step should be conducted at a temperature close to the melting point of magnesium to weaken the native oxide layer.

The synthesis of AE42 magnesium alloy foams is obtained using a camphene-based freeze casting method. Morphological analysis of the foams including the pore configuration, porosity, and strut width has been conducted through optical micrography, scanning electron micrography (SEM) and mercury intrusion porosimetry (MIP) observation. The compositional distribution was examined using X-ray diffraction (XRD) and electron dispersive X-ray spectroscopy (EDS). A compressive test has been performed to determine the deformation behavior and mechanisms of the magnesium foams. In particular, an acoustic emission (AE) analysis, which provides information on sudden, localized structure changes in the material, was carried out during the compressive test to investigate the deformation behavior and reliability of the AE42 foams, and the results have been compared with the compressive curves. Additionally, electrochemical measurements have been conducted in a simulated in-vivo condition for evaluation of the biocorrosion properties of the scaffolds. Potentiodynamic polarization (PD) and electrochemical impedance spectroscopy (EIS)

have been carried out in a simulated in-vivo condition with incubation for assessment of the biocorrosion properties.

Processing Example of Magnesium Alloy Foam

To synthesize the magnesium alloy foams, 40 volume-percent AE42 magnesium alloy powder (4 percent aluminum, 2 percent rare earth alloy of magnesium, particle size=36-45 microns, Materials Science and Engineering UG Clausthal-Zellerfeld, Germany) was suspended in a solution of 3.6 milliliters liquid camphene (about 95 percent purity, Sigma-Aldrich, St. Louis, MO, USA) containing 5 weight-percent binder (Polystyrene, $M_m$=35,000, from Sigma-Aldrich, St. Louis, MO, USA). To stabilize the suspension, 2 weight-percent oligomeric polyester (Hypermer KD-4, Croda, Snaith, UK) was added as a dispersant. As shown schematically in FIG. 1, the suspension was uniformly dispersed by stirring in a 60 degrees Celsius warm-water bath. The prepared warm suspension was poured into a Teflon or polytetrafluoroethene mold (21 millimeters in diameter and 25 millimeters in height) on a copper rod, with the temperature maintained at −20 degrees Celsius for 30 minutes using liquid nitrogen and the induction heater. After solidification, the frozen green body was placed in an air hood for 7 days to allow for the sublimation of camphene. To improve sinterability, the resultant green body was placed in an alumina crucible and stuffed with graphite powder (mean particle size of about 7-11 microns, Thermofisher Scientific, Waltham, MA, USA), and then sintered with two steps: (i) burning of chemical additives (binder and dispersant) at 450 degrees Celsius for 4 hours and (ii) sintering of magnesium alloy green body at 640 degrees Celsius for 10 hours. Each of the steps was performed under argon flow with a heating rate of 5 degrees Celsius per minute.

Optical microscopy (OM; PME 3, Olympus, Japan) and SEM (JSM7401F, JEOL, Tokyo, Japan) were used to observe the microstructure of the magnesium alloy scaffold. XRD (Rigaku, D/MAX2500, Japan) and EDS were used to determine the composition of the manufactured magnesium alloy foam. The size and distribution of pores and the porosity were analyzed using MIP (AutoPore IV 9520, Micromeritics, GA, USA). To confirm the MIP results, the overall porosity was calculated by considering the theoretical density of bulk AE42 (1.78 grams per cubic centimeter) and the mass volume determined from diameter and height measurements.

A compressive test was carried out for the evaluation of the mechanical integrity using an Instron ° 5882 machine with a constant cross-head speed of 0.27 millimeters per minute. The compressive behavior of three cylindrical specimens 4.5 millimeters in length and 3 millimeters in diameter showed good reproducibility. Concomitant with the compressive deformation test, a high-resolution digital camera scanned the specimen surface. The recorded video was then used to calculate the strain maps of the surface using digital image correlation (DIC). The AE signals were recorded simultaneously with the deformation test using a computer controlled PCI-2 device (Physical Acoustic Corporation—PAC), with a PAC Micro30S broadband sensor and a PAC 2/4/6-type pre-amplifier providing a gain of 40 decibels. The AE was measured in a hit-based mode where the AE signal was parameterized in real-time using a threshold level (set as 26 decibels in our case) and hit definition time (HDT-400 microseconds). The raw signal was also recorded concurrently (so-called waveform streaming mode) with no set threshold level and the AE data was analyzed during post-processing. A rate of 2 million samples per second was used in this case for data recording.

Measurements of the biocorrosion properties were conducted using simulated in-vivo conditions in 5 milliliters of culture medium, Eagle's minimum medium supplemented with 10 percent fetal bovine serum (E-MEM+10 percent FBS) pre-conditioned at 37 degrees Celsius under an atmosphere of 5 percent CO 2 in humidified air. A three-electrode cell was used for measurements and testing was conducted under a simulated in-vivo condition with incubation. A platinum wire was used as the counter electrode, Ag/AgCl (3 molar NaCl) was used as the reference, and the machined magnesium alloy foam was used as the working electrode. The area and thickness of the magnesium foam were set as 0.332 square centimeters and 1 millimeters, respectively, to be used as the working electrode. A PD test was conducted after 24 hours incubation with respect to the open circuit potential (OCP) at a scanning rate at 0.5 millivolts per second from −0.25 to 1.2 volts. An EIS test was conducted at 2, 6, 12, and 24 hours of incubation at the OCP with an AC amplitude of 5 millivolts in a frequency range of $10^{-2}$ to $10^{5}$ hertz. All of the electrochemical data were obtained using a potentiostat equipped with a frequency response analyzer (VersaSTAT3, Princeton Applied Research, USA).

Results and Discussion

Figure 2B:
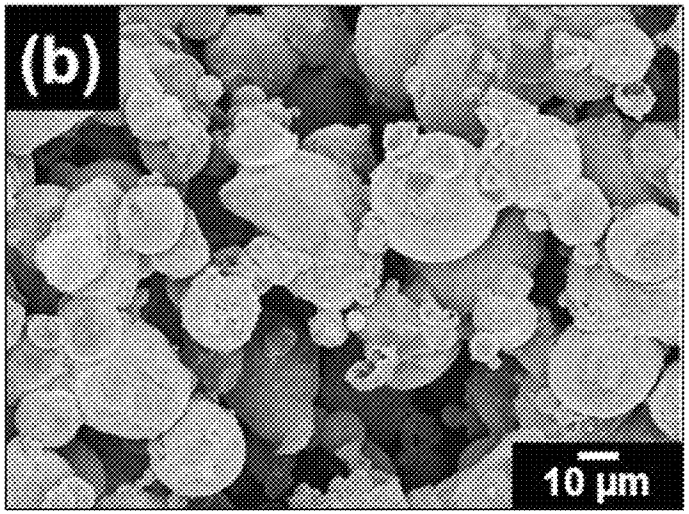
FIGS. 2A-2C shows an optical (2A) and SEM (2B, 2C) micrographs of the as-prepared AE42 magnesium alloy foams: (2A) cross-sectional morphology after mounting and polishing; (2B) low-magnification, and (2C) high-magnification observation of fracture morphology.
Figure 2C:
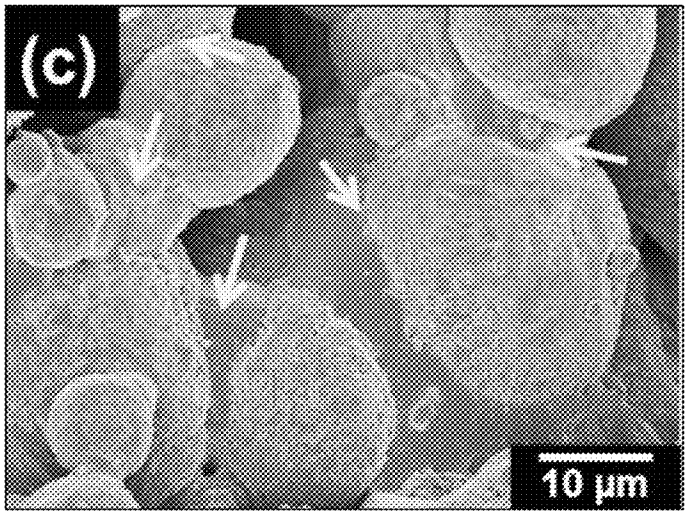
Figure 2A:
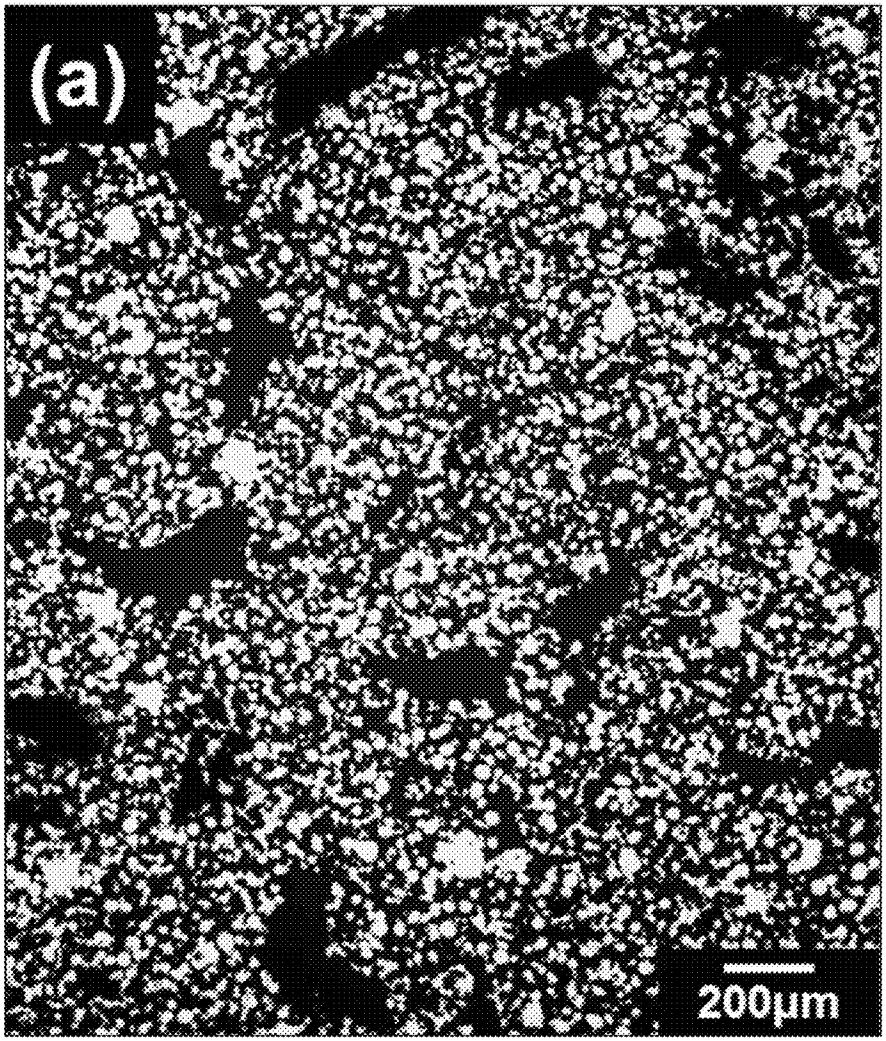

The cross-sectional image of the synthesized magnesium alloy foam is shown in FIG. 2A. The microstructure of the magnesium alloy foam prepared using freeze casting with camphene consisted of uniformly distributed small pores in the range of a few tens of microns between bead-shaped magnesium alloy struts including occasional larger pores on the order of a couple hundred microns. Based on an understanding of camphene-based freeze casting techniques, the foam's general pore morphology is composed of dendritic struts and pores due to the nature of solidification of the camphene solvent. This microstructural feature is also inconsistent with the features of foams fabricated using the commonly known freeze casting based on water solutions. During the solidification process, the starting particles are rearranged alongside the dendritic growth of the solvent, resulting in dendritic pores and struts. These phenomena are expected to be difficult to take place during the solidification of the solvent as the particle size increases. Since the mean diameter of the starting particles used was relatively larger (about 43 microns) than those previously used in conventional freeze casting, the migration of particles from the slurry to the outer region of solidified solvents for the formation of dendritic pores was impeded, resulting in the settlement of particles at the inner region of the frozen solvents. In addition, a solidification temperature of −20 degrees Celsius was used, which is much lower than the range of solidification temperature of the camphene solvent (about 40 degrees Celsius). The solidification of the solvent and the expulsion of particles from the slurry to the outer region of the frozen solvent competitively occur during freeze casting. Since higher undercooling supplies a larger driving force for the solidification process, the solidification transformation can be completed before full expulsion of particles from the frozen solvent as the freezing temperature decreases. Both parameters could thus lead to the formation of dendrite-shapeless microstructures unlike previous attempts.

Further microstructural characterization of the magnesium alloy foams was carried out via scanning electron microscope (SEM) analysis. FIGS. 2B-2C presents the SEM micrographs of the fractured surface of the magnesium alloy foams. The shape of the struts was in the form of a "bead-connected ligament" and three-dimensional (3D) open pores were observed around the struts. Based on these images, the pore size distribution ranged from a few tens to hundreds of microns and the pores were open-connected regardless of the pore size in this foam. Enhanced remedy efficiency may be achieved using open-connected foam structure for biomedical applications rather than a bulk structure because the open-connected pores in magnesium alloy foams can serve as a support site for cell absorption, proliferation, and the permeation of body fluid and by-product gas, which can eventually promote healing. In addition, a few tens to hundreds of micrometer-sized pores can be particularly effective for achieving the promotion of healing. Therefore, the foams synthesized obtained should improve heading efficiency as advanced orthopedic devices.

Figure 3:
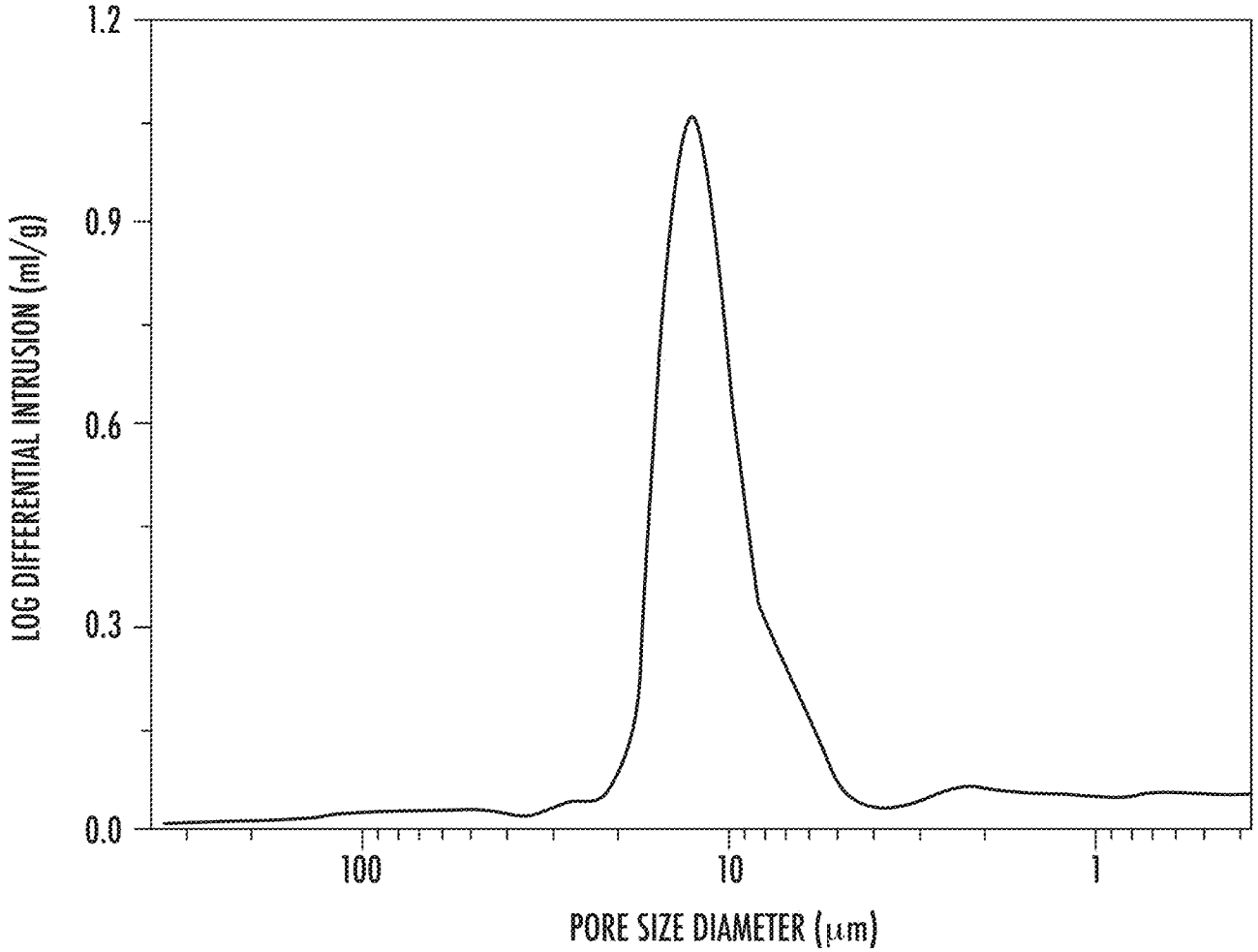
FIG. 3 shows pore size distribution of the resulting AE42 magnesium alloy foams acquired using MIP.

An MIP test was performed to determine the pore size distribution and porosity of the magnesium alloy foam. The pore size distribution is illustrated in FIG. 3. The median pore diameter was 12.6 microns and the porosity was 51.6 percent. The pore size distribution is in agreement with the image analysis results (FIGS. 2A-2C) and the porosity from the MIP test is well matched with the numerically calculated porosity using five fabricated foam samples.

Figure 4:
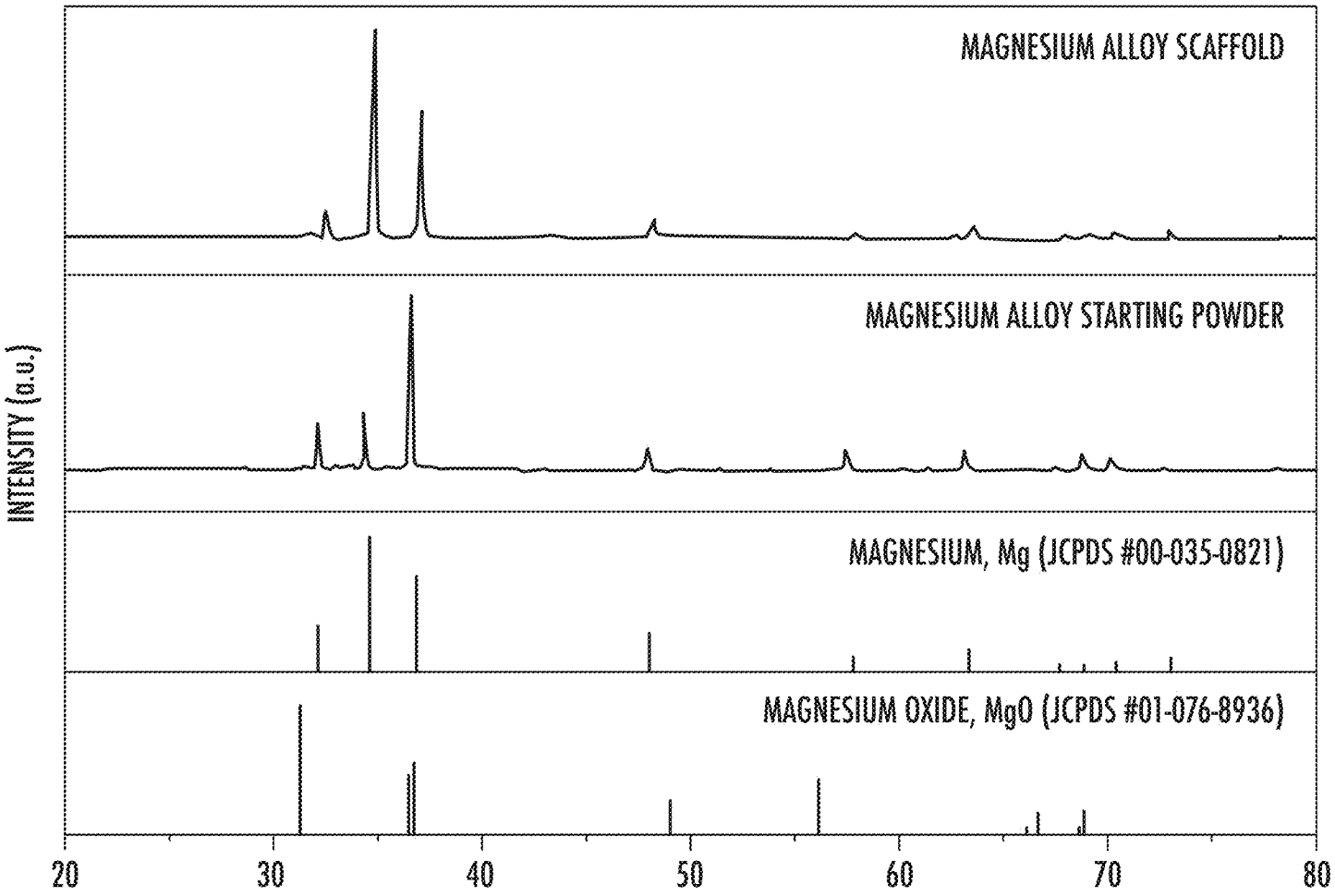
FIG. 4 shows XRD patterns of the starting powder and the resulting scaffolds in comparison with the standard peak of magnesium (JCPDS #00-035-0821) and magnesium oxide (JCPDS #01-076-8936).

The XRD patterns of the as-received magnesium alloy powder and the fabricated magnesium alloy foam are illustrated in FIG. 4 with the standard peaks for pure magnesium and magnesium oxide. A comparison of the XRD patterns for the magnesium alloy powder and the foam with those for the reference patterns of magnesium and magnesium oxide suggest that both the magnesium alloy powder and the foam were predominately magnesium with no observable secondary phase except for a small amount of magnesium oxide. These results indicate that the magnesium alloy foam was successfully fabricated without significant phase transition or the generation of a second phase despite the severe heating condition of 640 degrees Celsius for 10 hours considering its relatively low melting temperature.

Figure 5A:
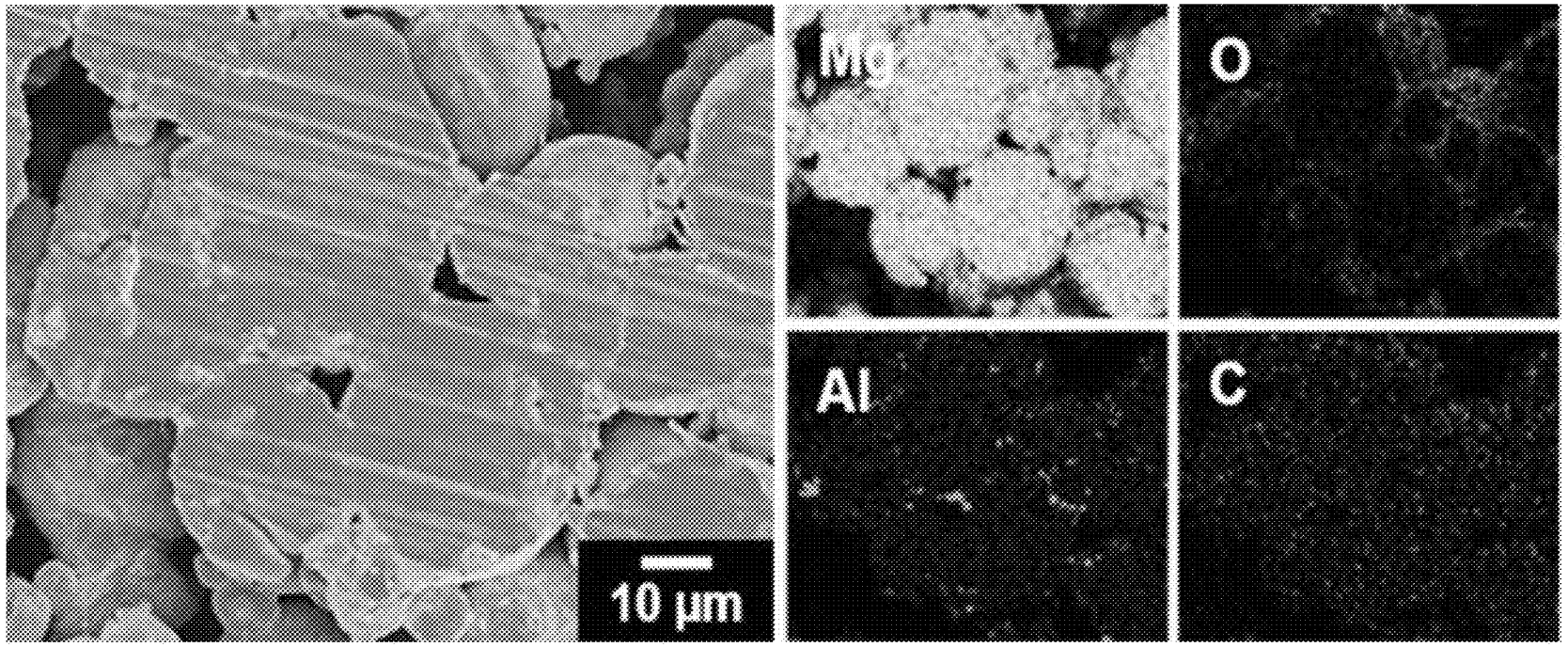
FIGS. 5A-5B show (5A) SEM and EDS mapping images of the polished surface of the resulting AE42 magnesium alloy foams and (5B) comparison of the chemical composition of the starting powder and the resulting foams determined using EDS. Vertical bars represent the weight percent of magnesium (Mg), oxygen (O), carbon (C), and aluminum (Al) in the samples.
Figure 5B:
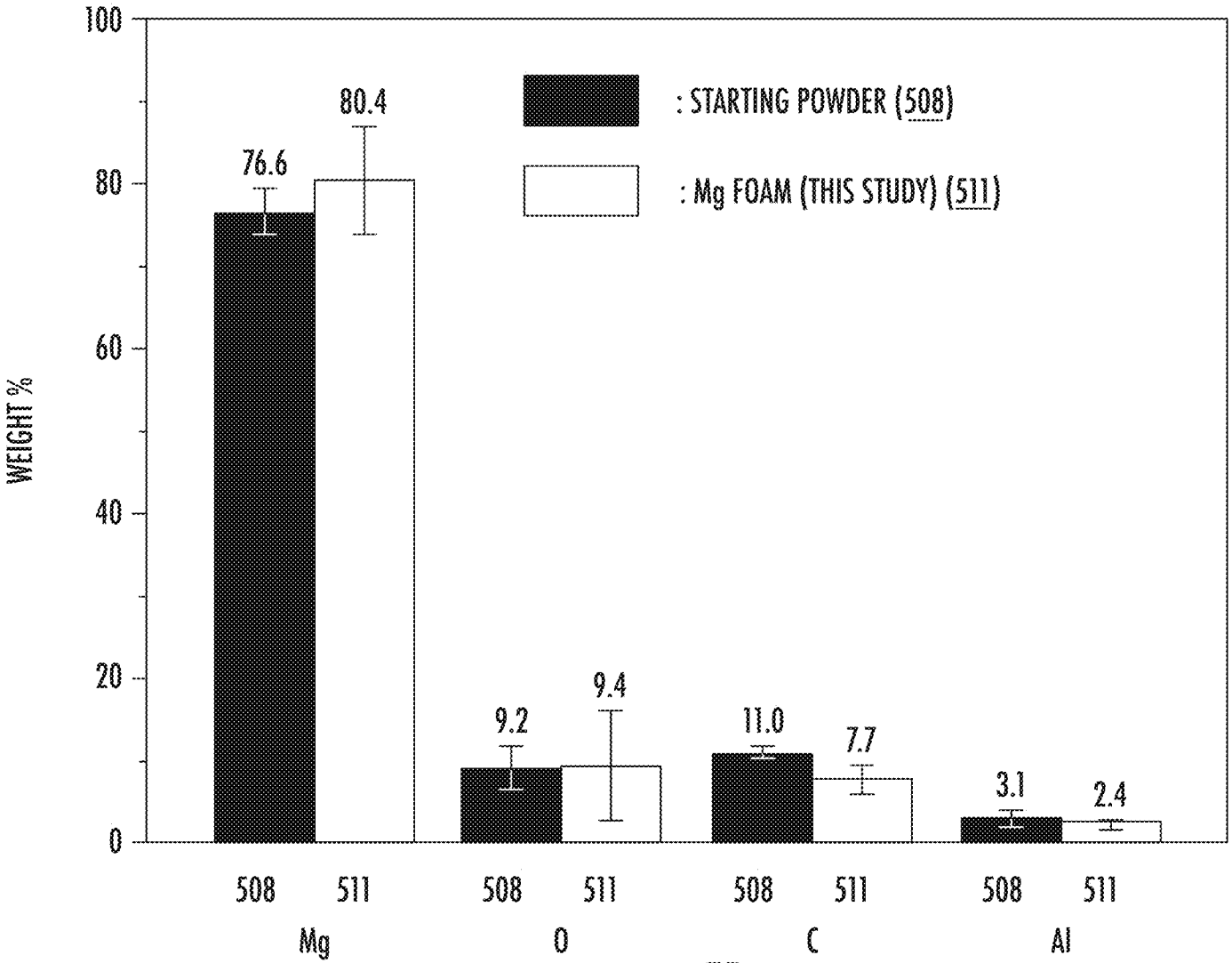

The EDS mapping analysis in FIG. 5A shows that the distribution of the composed elements is quite uniform on the polished surface of the magnesium alloy foam. The EDS mapping analysis results also showed no observable changes in the phases between the starting powder and the foam (FIGS. 5A-5B). Based on FIG. 5A, several points are noteworthy. First, magnesium is the dominant element in the struts of the foam regardless of heat treatment. This is in good agreement with the XRD results in FIG. 4. Second, oxygen existed in the form of oxide and was detected only around the outer surface of the struts of the foam. This indicates that thermal oxidation occurred on the surface of the particles during heat treatment. Third, aluminum was uniformly detected with a few agglomerated zones and appeared to have been created as a result of localized melting.

FIG. 5B shows a comparison of the weight percent of the chemical components in the starting powder 508 and the foam 511. There was no significant change in the chemical compositions after heat treatment. This indicates that the composition of the magnesium alloy foam was considerably well maintained during heat treatment. According to the sequential componential analyses results, the heat treatment applied to sinter the magnesium powder using carbon as a sintering buffer was appropriate for manufacturing the magnesium alloy foam.

Figure 6A:
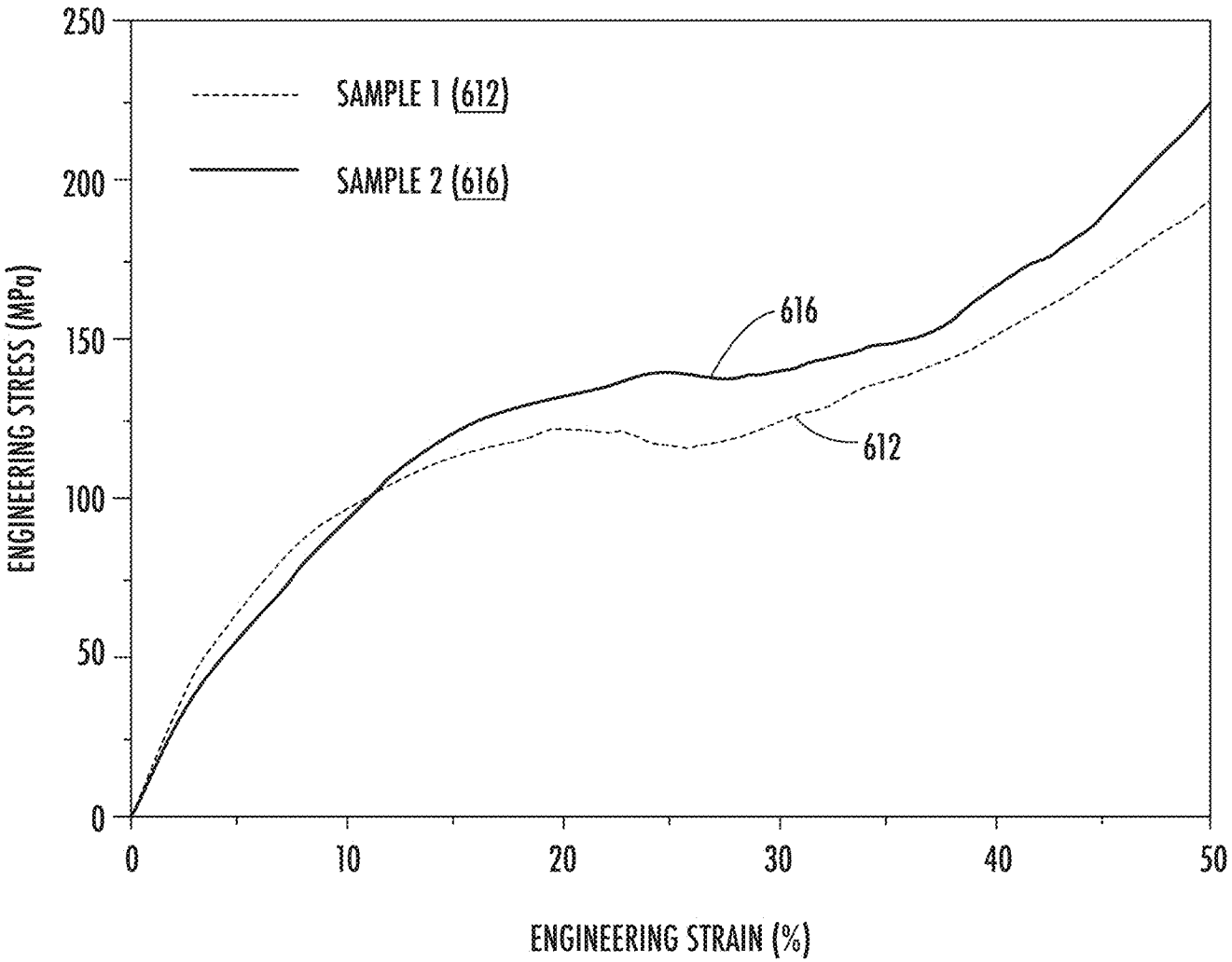
FIGS. 6A-6B show (6A) the curves of compressive deformation with a cross-head speed of 0.27 millimeters per minute for the cylindrical specimen (4.5 millimeters in length and 3 millimeters in diameter) and (6B) strain maps of the compressive deformed specimen acquired with digital image correlation (DIC).
Figure 6B:
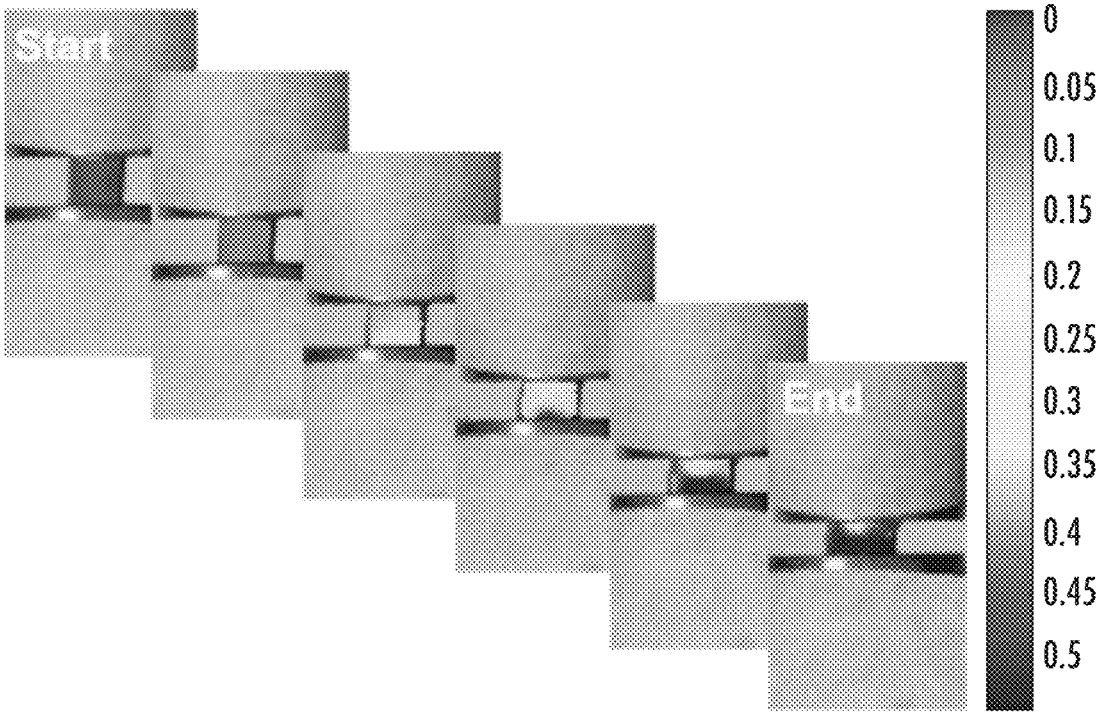

As shown in FIG. 6A, the compressive deformation behavior of the magnesium foam sample (e.g., sample 1 612 and sample 2 616) exhibited good reproducibility, suggesting that the foams manufactured in this invention have uniform microstructure. After the yield point (about 50 megapascals) was reached, strain hardening occurred up to about 120 megapascals, around which a short plateau was observed, caused by the densification of the foam sample. The plateau, however, was shortly followed by a second hardening stage. Additionally, DIC confirmed that no strain localization took place during the compressive deformation of the magnesium foam sample (FIG. 6B).

Figure 7:
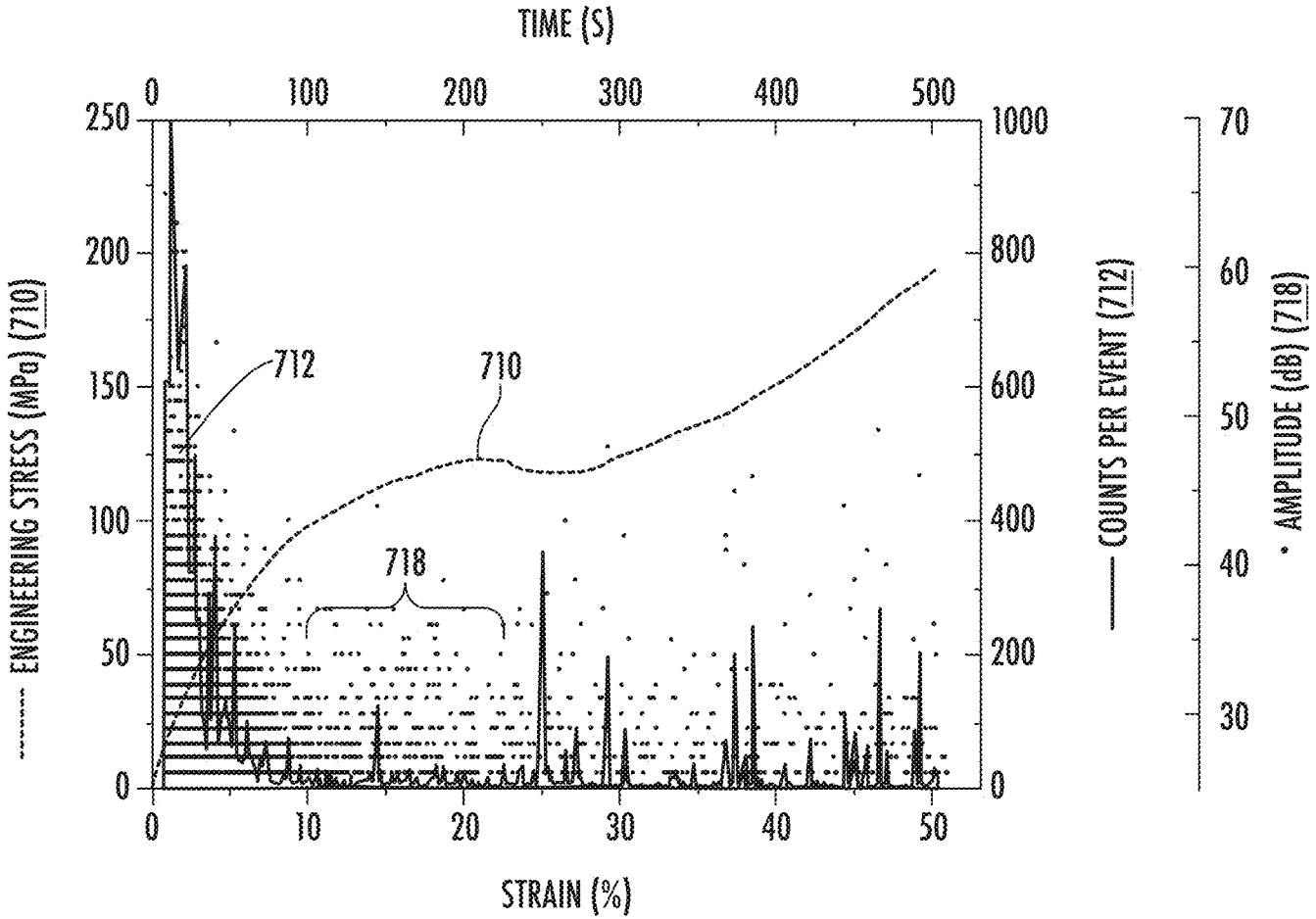
FIG. 7 shows compressive stress-strain curve and AE response for the AE42 magnesium alloy foams: stress-strain curve (black line 710), AE count rate (red peaks 712), and AE amplitude (blue dots 718).

In FIG. 7, the AE count rate 712, amplitudes 718, and the corresponding deformation curve 710 is plotted (due to their behavioral similarities, the results for only one of the two samples is shown). The majority of the large amplitude AE signals are concentrated at the yield point region, but some high amplitude signals can also be observed at the stress plateau region and the terminal stage of deformation.

The AE count rate curve has a distinct peak around the macroscopic yield. Such an AE response is commonly observed in bulk magnesium alloys, where the peak is connected to the concurrent role of the dislocation slip (both basal and nonbasal) and the twinning in the plasticity. Metallic foams usually emit an evenly distributed average count rate throughout the test with no observable peaks, which is primarily a consequence of localized cell wall bending and collapsing. In our case, the plastic deformation of the magnesium foam appeared to be the governing deformation mechanism.

Figure 8:
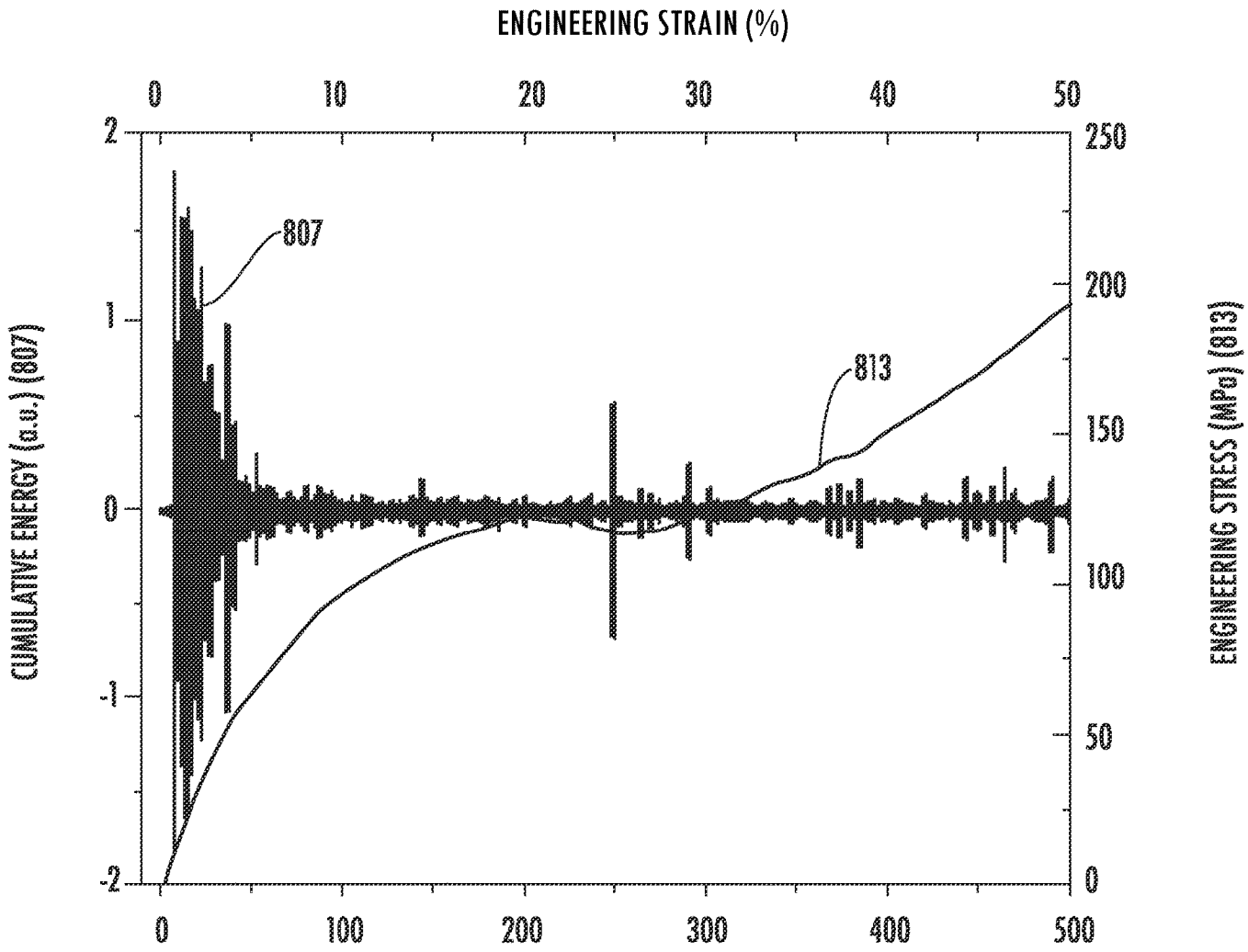
FIG. 8 shows as-measured acoustic emission streaming compared to the compressive deformation of AE42 magnesium alloy foams.

In order to verify this assumption, we recorded the raw AE data stream shown in FIG. 8, cumulative energy 807 and engineering stress 813. The characteristics of the signal were comprehensibly similar to those recorded in hit-based mode. Particularly, strong bursts in the plateau stage and at the end of the test were clearly visible. The data stream was processed by adaptive sequential k-means (ASK) analysis based on the other work. There are further details about the method and application examples for magnesium alloys and metallic foams. In the first step, the raw signal is sectioned into consecutive frames. The width of the frame, which determines the time resolution, can be set by the operator; we used a two-millisecond frame width in this case.

Subsequently, the power spectral density (PSD) function is calculated for each window. The clustering algorithm distributes the AE signals in the given frames according to the characteristic features (energy E, median frequency $f_m$, and amplitude A) of their PSD functions. The main advantage of the method lies in the fact that the initial reference cluster is determined from the background noise, which is recorded before launching the deformation. Every consecutive AE realization is then either assigned to the nearest cluster or used as the seed for a new cluster. Subsequently, the clusters should be assigned to particular AE source mechanisms. It should be noted that the method does not exclude the concurrent activity of multiple source mechanisms. Nevertheless, within a given frame, only one mechanism can be dominant (simply put—only one source can be the loudest in one moment). Based on this approach, four clusters were identified using the ASK method (FIGS. 9A-9E and 10), and the four clusters originated from the corresponding source mechanisms.

Cluster 1, Background noise (color code: blue 905): This cluster appears before the launching of the deformation. Consequently, it stems from the background noise. The elements in this cluster have low energy (E<0.1 atomic units (a.u.)) and a broad frequency spectrum (FIG. 9B), which are special characteristics of this source mechanism.

Cluster 2, Twinning (color code: pink 918): The twinning cluster starts to appear at relatively low stress, which is in good agreement with the low critical resolved shear stress (CRSS) of this mechanism. The elements in this cluster fall into a narrow frequency range and the majority of signals have high energy values (FIG. 9C), which is typical of twinning.

Figure 9A:
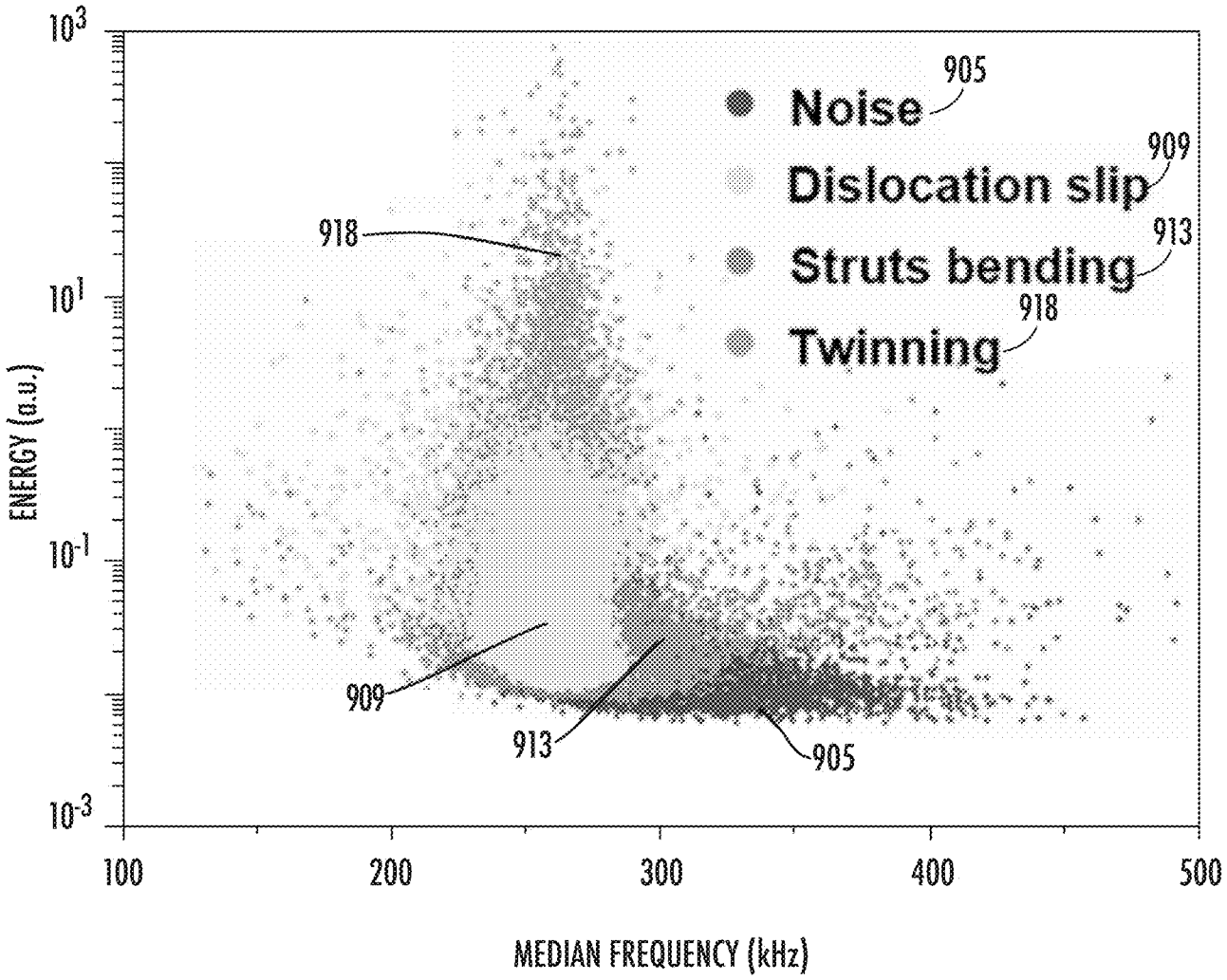
FIGS. 9A-9E show plots of clusters acquired from AE signals using the ASK procedure (9A) assigned to the following deformation mechanisms with (9B) noise, (9C) twinning, (9D) dislocation slip, and (9E) struts bending.
Figure 9B:
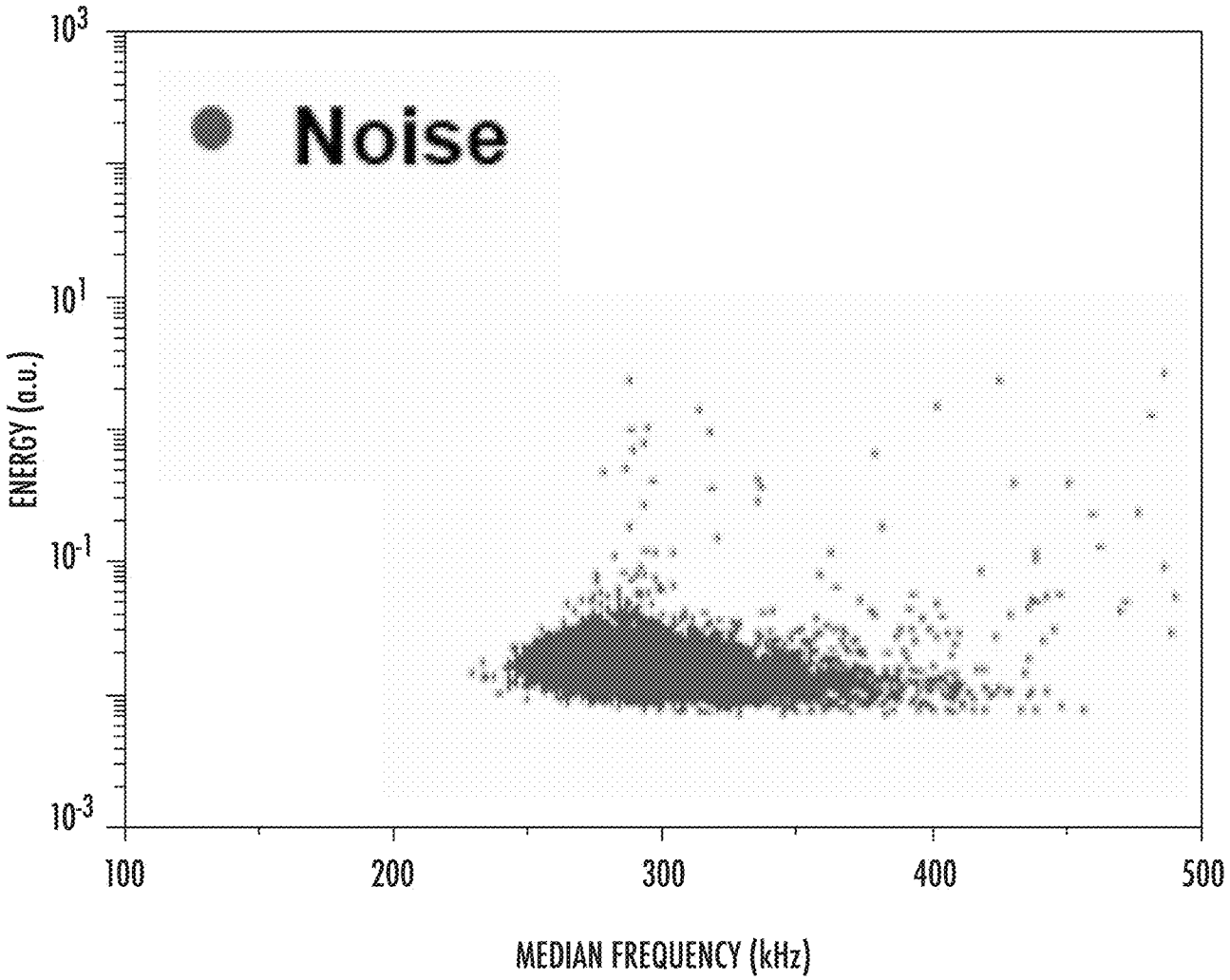
Figure 9C:
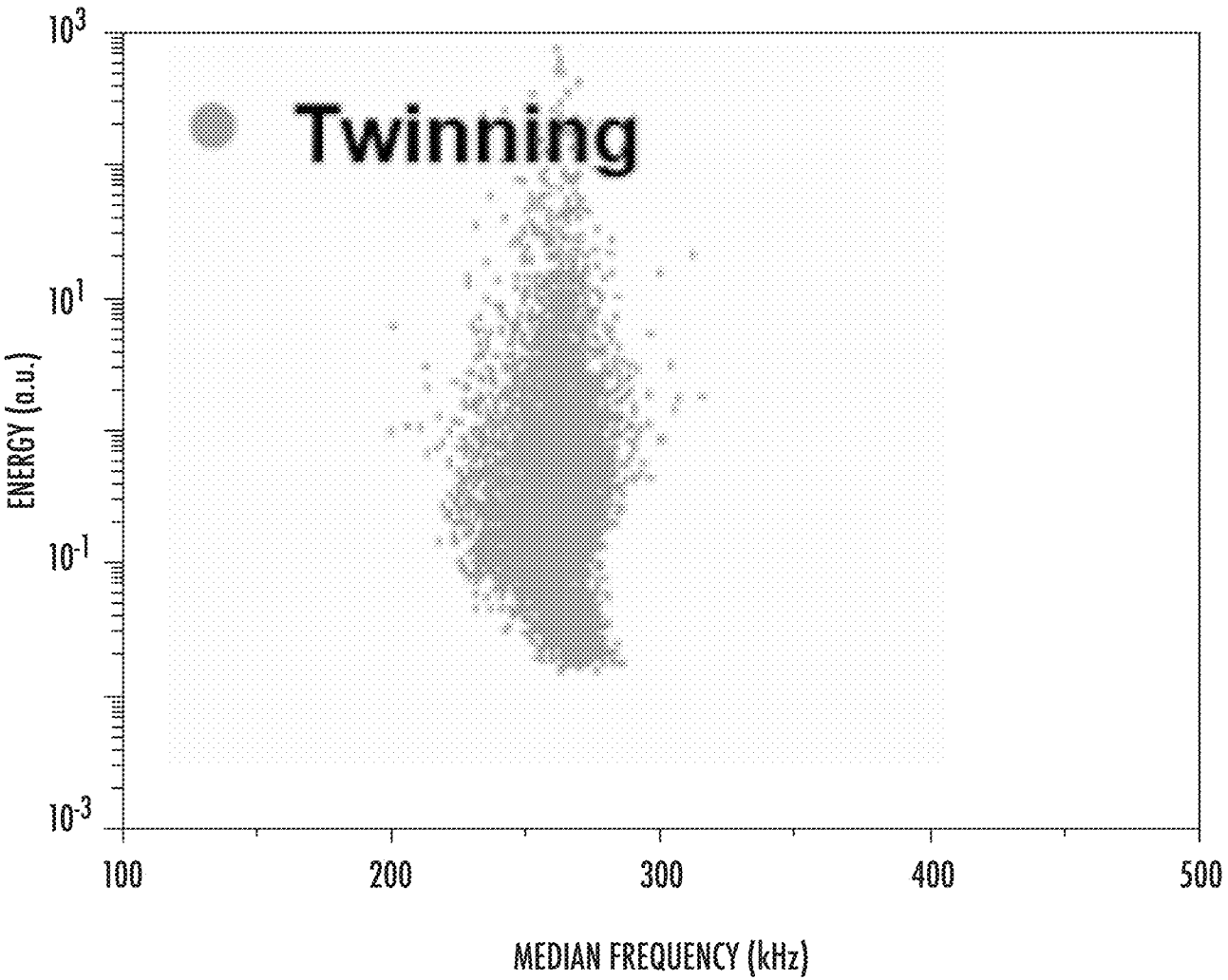
Figure 9D:
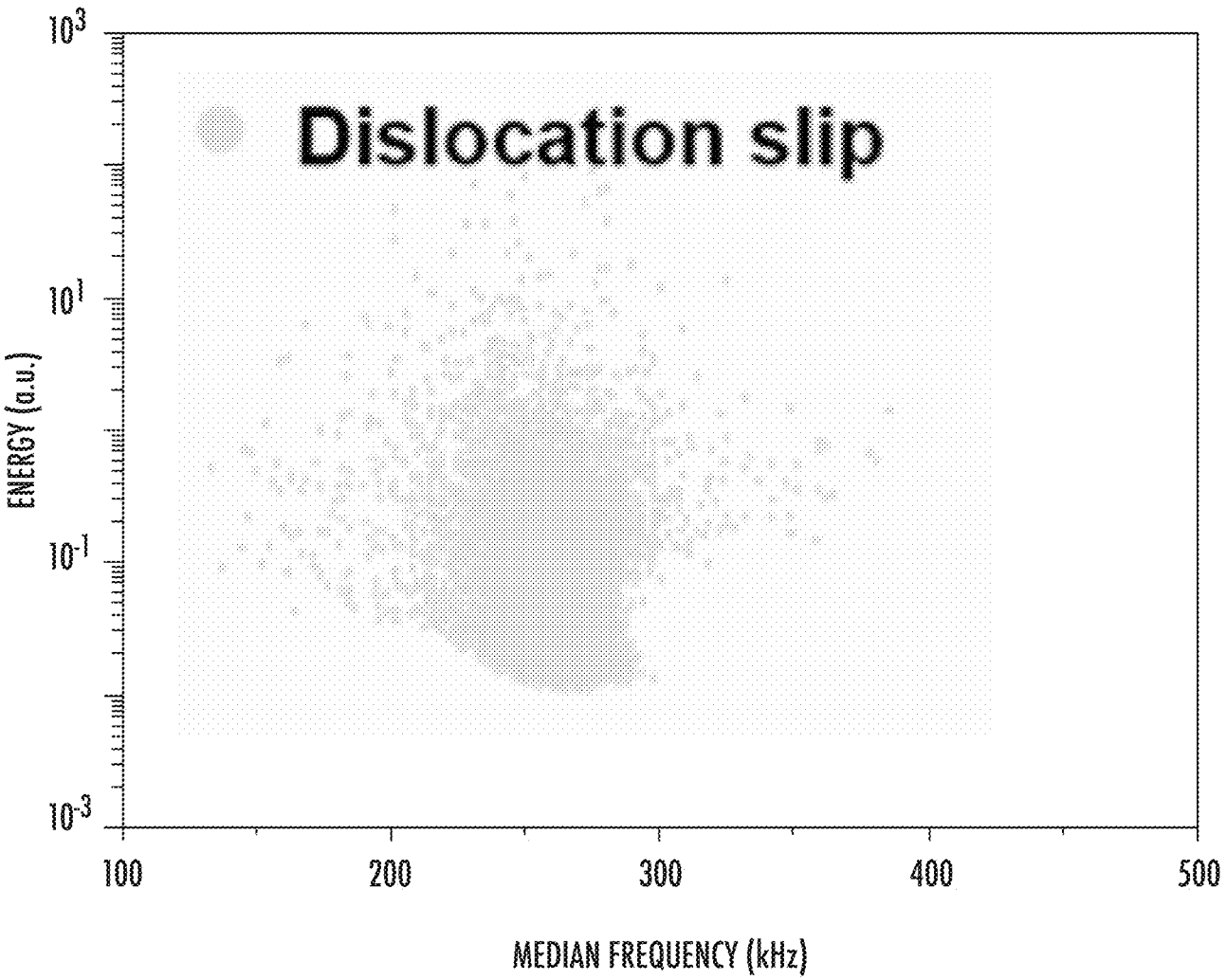
Figure 10:
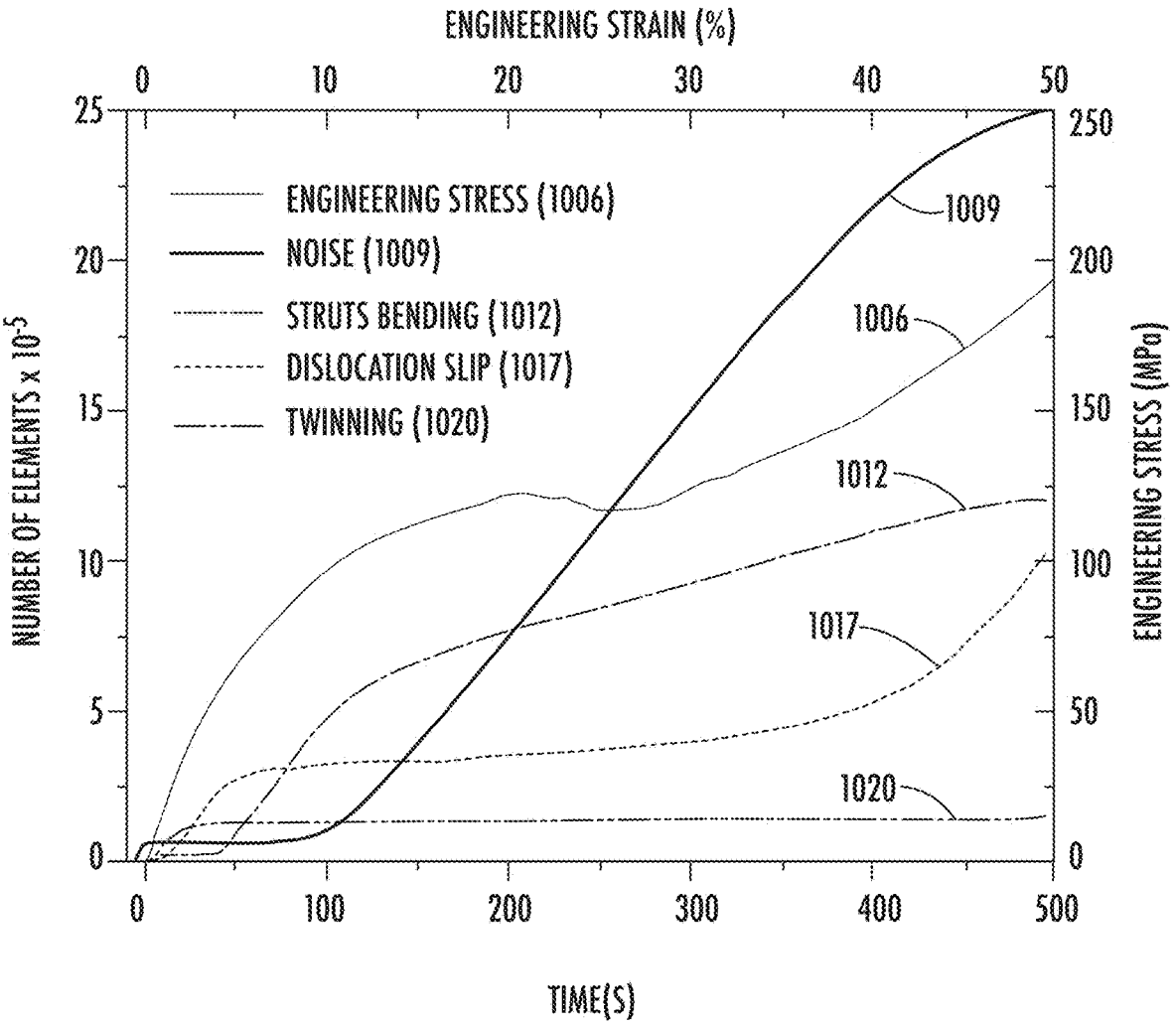
FIG. 10 shows time evolution of cumulative number of elements in the AE clusters assigned to the following deformation mechanisms: dislocation slip, struts bending and twinning.
Figure 17A:
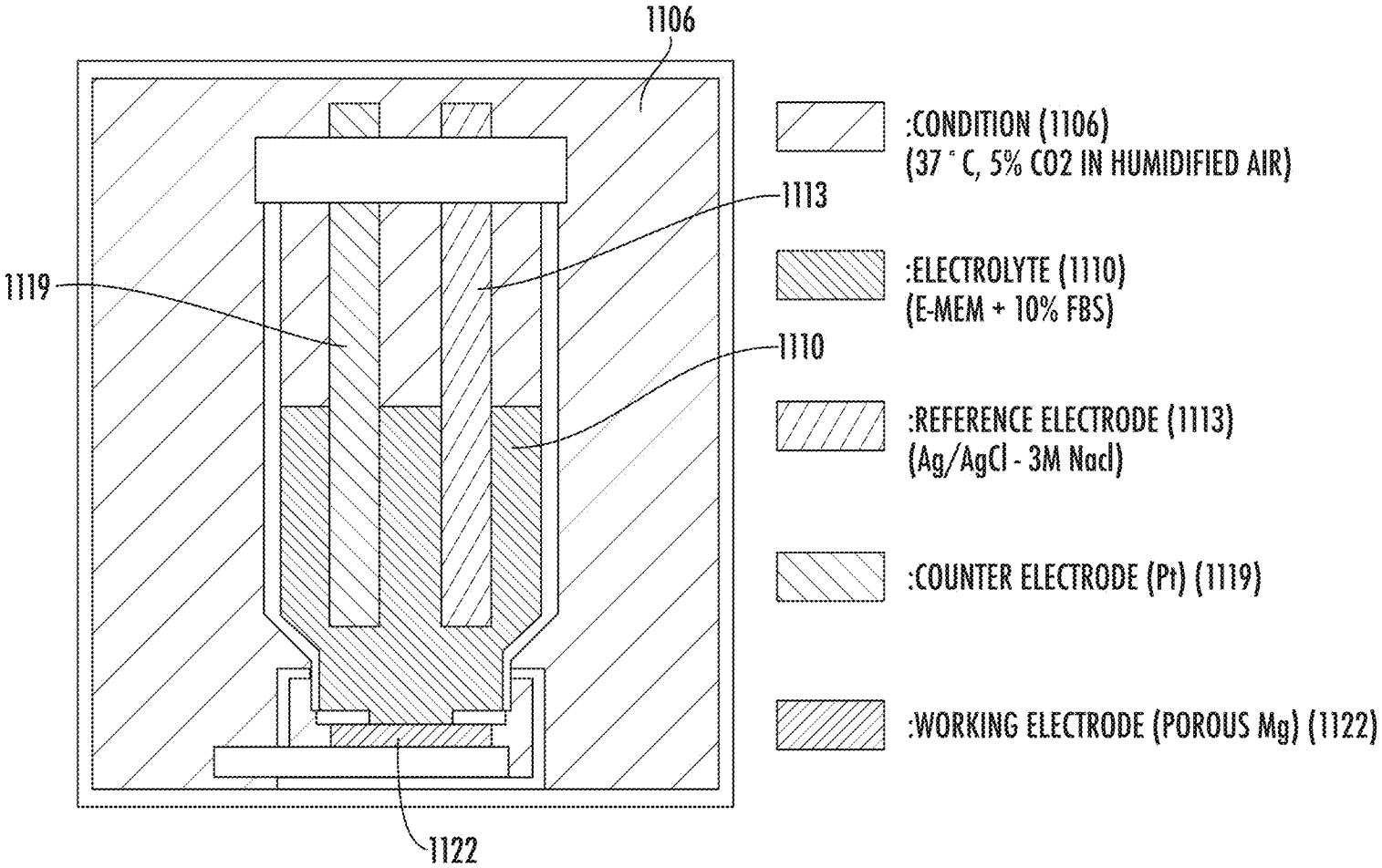

Cluster 3, Dislocation slip (color code: green 909): This cluster also appears at the beginning of the test after twinning (FIGS. 9D and 10). The elements in the cluster fall into a broader frequency range than those of the twinning cluster. Additionally, their energy has rather medium or low values (FIG. 9D). With increasing strain, the frequency of events decreases; indeed, this feature is associated with an avalanche-like dislocation movement. At the onset of straining, the dislocations can sweep a relatively large area, which results in medium energy signals. As the deformation progresses, the dislocation density increases. This leads to a decrease in the mean free path of the dislocations and decreasing frequency.

Cluster 4, Strut bending and collapsing (color code: red 913): Significant increment in the number of elements in this cluster can be observed from 5 percent strain and increases monotonically until the end of the test. The frequency range is wide (FIG. 9E—the frequency interval is over 150 kilohertz), but the overall energy is lower than that of the dislocation slip signals, despite their overall characteristic similarity.

ASK analysis revealed that in the elastic regime, the {10$\bar{\mathbf{1}}$2}⟨(10$\bar{\mathbf{1}}$1⟩ -type extension twinning controlled the deformation. In FIG. 10, curves for engineering stress 1006, noise 1009, struts bending 1012, dislocation slip 1017, and twinning 1020 are plotted. This microplasticity, caused by local stress concentrations, has also been observed. The twinning stopped dominating the AE spectrum at the strain of 2.5 percent. During compression, only a few twin variants were nucleated at the beginning of straining, which accommodated the strain with their growth. Although the AE method is capable of detecting only twin nucleation and propagation, we were interested in the growth of the twin in length. As was previously shown, this stage of twinning took place at the speed of several meters per second, accompanied by high energy bursts. In contrast, the twin growth (i.e., its thickening) was approximately four orders slower and the released energy was too low to emit a detectable AE. Consequently, the twinning did not contribute significantly to the AE at later stages of deformation. On the other hand, the dislocation cluster became significant at low stress levels, which is preferentially provided by easy activation of the basal slip. Around the yield point, this mechanism became dominant, which confirmed the earlier observation of the importance of the nonbasal slip in the macroscopic plasticity of magnesium alloys.

Figure 9E:
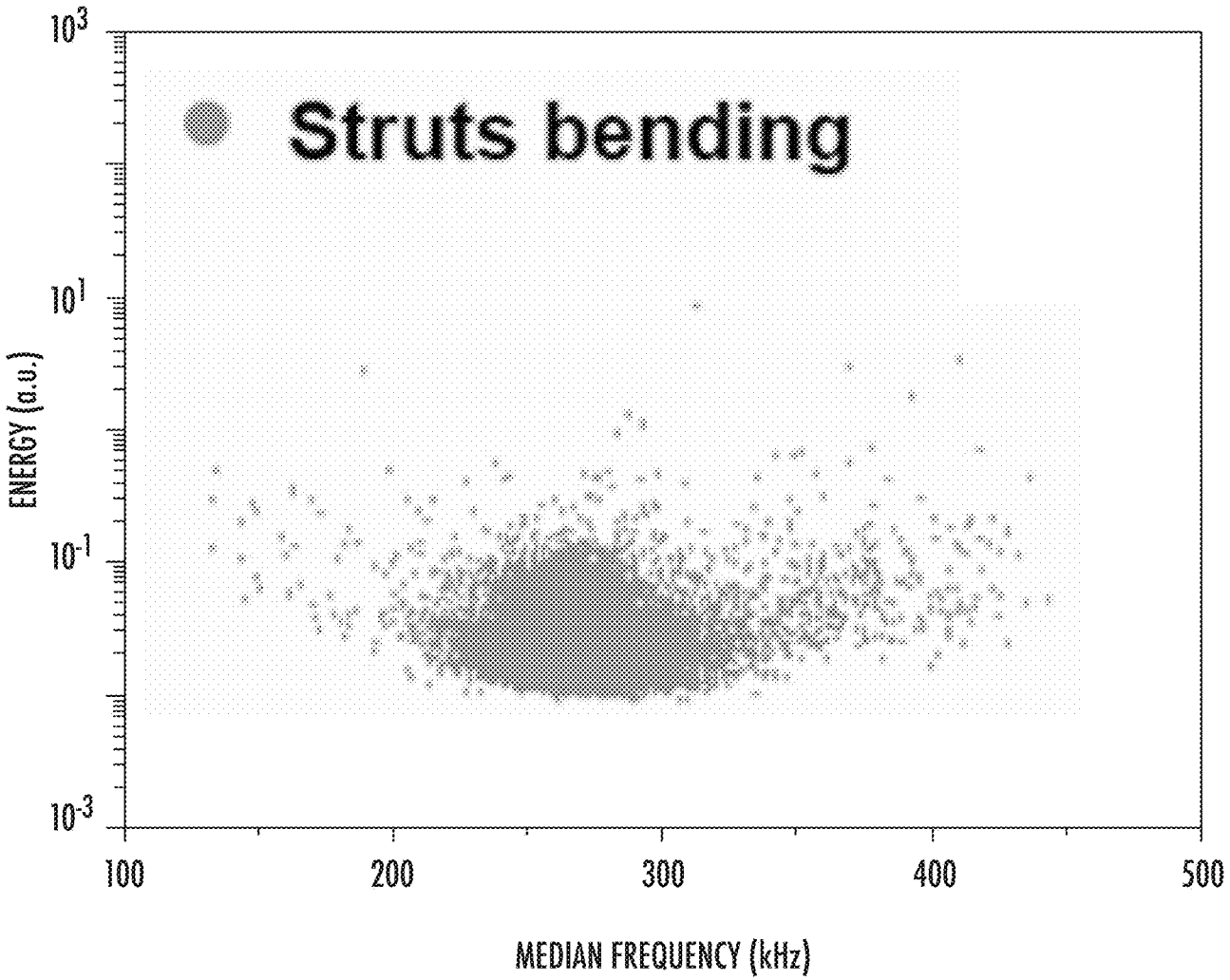

According to the ASK analysis, the weak struts of the foam structure appeared to be bent shortly after reaching the yield point. This is indeed not surprising if we consider that the dimension of the struts exhibited significant scatter. The bending process is controlled by dislocations; however, the energy of the released AE signal is smaller owing to the lower correlation of the dislocation movement. During the bending process, the particular struts change their orientation with respect to the loading axis. Consequently, dislocation slip can take place in the grains, which were not favorably oriented in the initial stage. During this process, the dislocation mean-free-path can increase, which leads to an increase in the frequency. Therefore, the strut-bending cluster has the form of an "eye" in the energy-median frequency plot (FIG. 9E). It is worthy to note that the noise cluster became dominant above the stress plateau. This effect can be rationalized by friction between the bent struts.

Figure 11B:
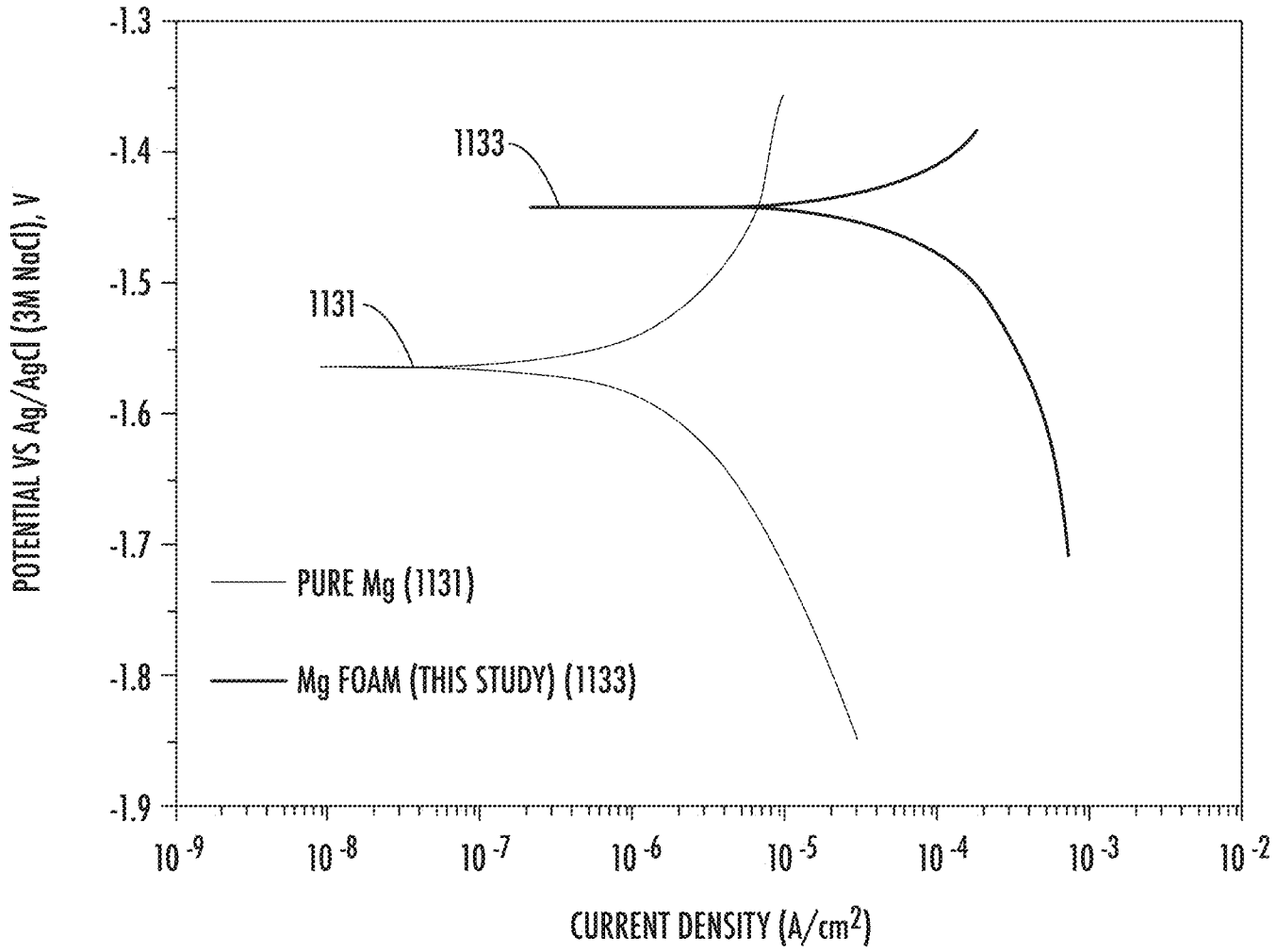

To verify the electrochemical behavior and properties of the magnesium alloy foam in the simulated in-vivo condition, PD and EIS tests were performed in an incubation system (FIG. 11A). FIG. 11A shows condition 1106, electrolyte 1110, reference electrode 1113, counter electrode 1119, and working electrode 1122 of the incubation system. Additionally, the pure bulk magnesium in the same dimension was also used as a working electrode for comparison with the magnesium alloy foam. Through the PD test shown in FIG. 11B, corrosion parameters such as the corrosion potential ($E_{corr}$), current densities ($I_{corr}$), and tafel constant for the anodic and cathodic reaction ($b_a$, $b_c$) were determined and the polarization resistance ($R_p$) was calculated through the Stern-Geary equation (equation 2 below). FIG. 11B shows a curve 1131 for pure magnesium and a curve 1133 for magnesium foam. The values of the corrosion parameters obtained from PD curves are also summarized in table B.

Table B: Electrochemical Parameters of Potentiodynamic Polarization Curves for Pure Magnesium and Magnesium (AE42) Alloy Foams.

TABLE B

Electrochemical Parameters of Potentiodynamic Polarization Curves for Pure Magnesium and Magnesium (AE42) Alloy Foams.

| Samples | Corrosion potential ($E_{corr}$, V) | Corrosion current density ($I_{corr}$, $\mu A \cdot cm^{-2}$) | Anodic tafel constant ($b_a$, mV) | Cathodic tafel constant ($b_c$, mV) | Polarization resistance ($R_p$, (Ω) |
|---|---|---|---|---|---|
| Pure magnesium | −1.563 | 7.848 | 263.42 | 257.89 | 7.22 Ω |
| Porous AE42 | −1.442 | 930.9 | 465.55 | 488.77 | $1.11\ \Omega \times 10^{-2}$ |

Equation 2

$$R_p = \frac{b_a b_c}{2.3\, I_{corr}(b_a + b_c)} \quad \text{(Eq. 2)}$$

The corrosion potential of the magnesium alloy foams (−1.442 volts) was higher than that of pure bulk magnesium (−1.563 volts). This tendency is in good agreement with expectations on the enhanced in-vivo corrosion resistance of magnesium alloy compared to that of pure magnesium. Nevertheless, the corrosion current density and the polarization resistance of the magnesium alloy foam were higher than those of pure magnesium. In other words, the corrosion rate of the magnesium alloy foam was faster than that of bulk pure magnesium. These conflicting results were most likely due to the extended surface area of the magnesium alloy foam compared with that of the pure magnesium, based on the assumption that their starting apparent dimensions were the same. An analytical calculation of the specific area of the magnesium alloy foam and the bulk pure magnesium was conducted based on the reference, with the assumption that both samples had the same dimensions machined (0.332 square centimeters working area, 1 millimeters thickness). Comparison calculations showed that the value of the specific surface area of the magnesium alloy foam ($3.12\times10^{-2}$ square meters per cubic centimeter) was approximately 13 times larger than that of bulk magnesium ($2.36\times10^{-3}$ square meters per cubic meters). Consequently, the magnesium alloy foam could be corroded faster than pure magnesium despite its enhanced cure efficiency. It is however worthy to note that the corrosion rate of the magnesium alloy foam can be modified by adjusting its porosity, which can be accomplished by controlling the parameters of the magnesium foam synthesis process.

Figure 11C:
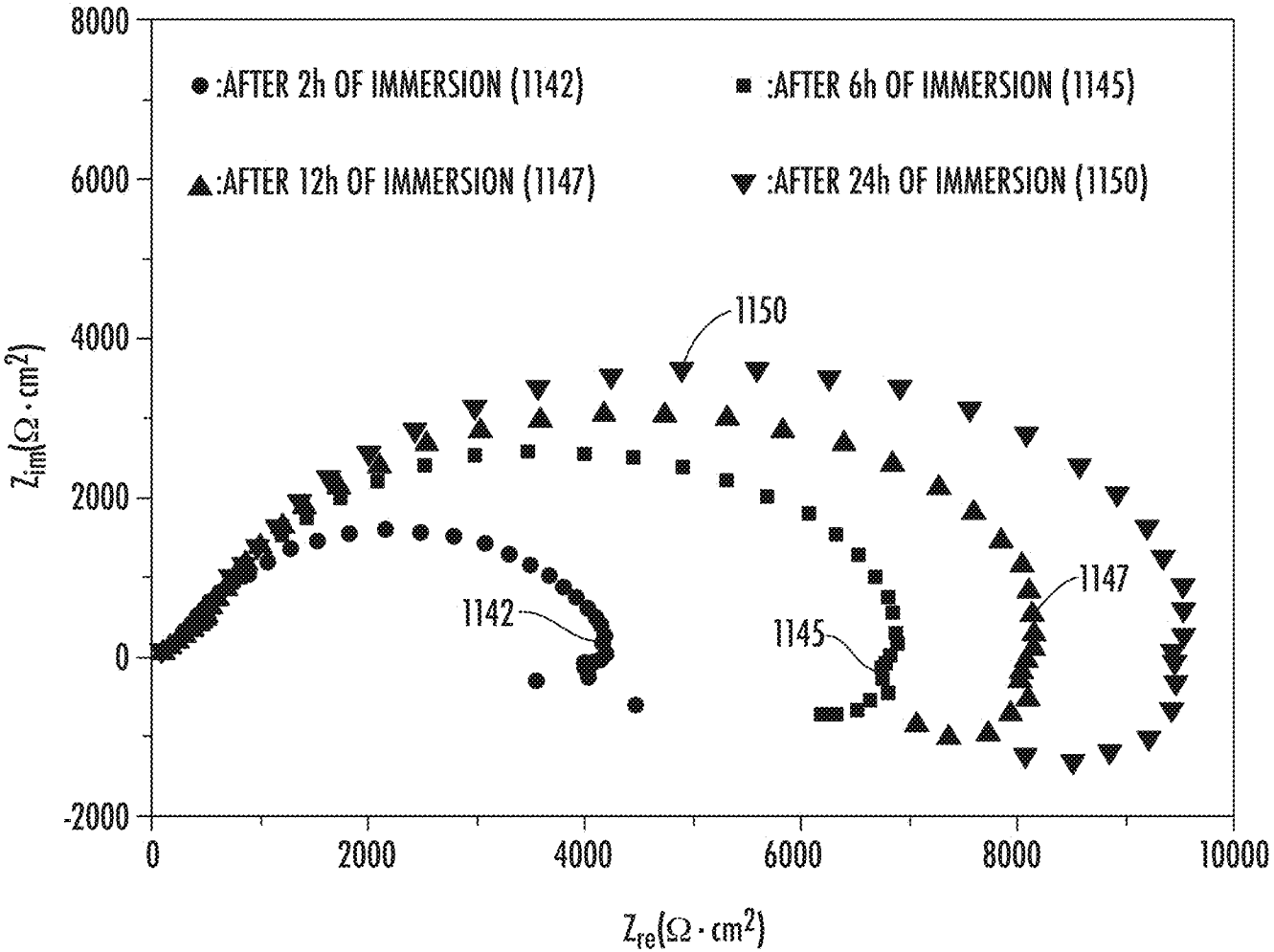
Figure 11D:
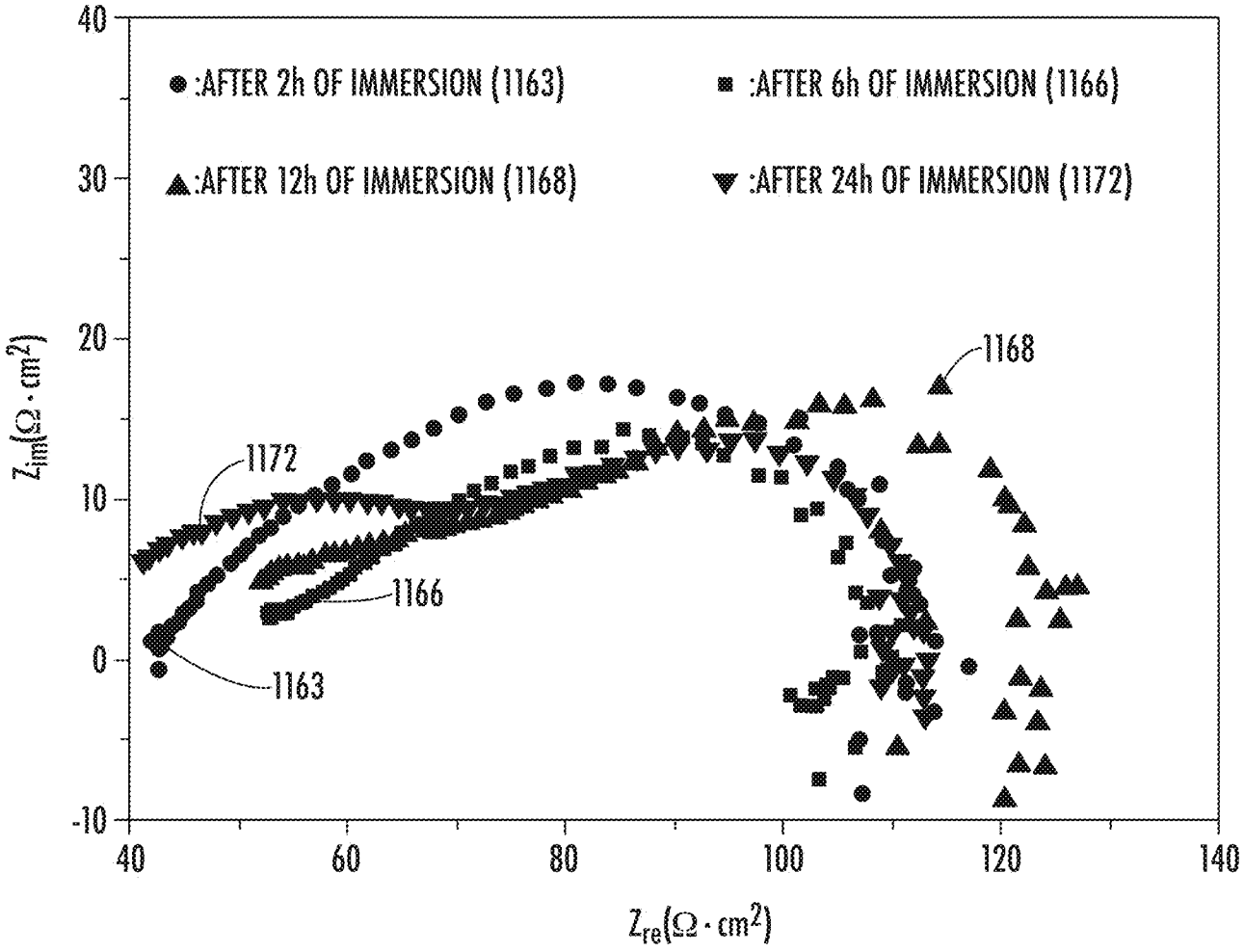

FIGS. 11C-11D shows the EIS results for pure bulk magnesium and the magnesium alloy foam. EIS was conducted after incubation for 2, 6, 12, and 24 hours. FIG. 11C shows results 1142 for after 2 hours of immersion, results 1145 for after 6 hours of immersion, results 1147 for after 12 hours of immersion, and results 1150 for after 24 hours of immersion. FIG. 11D shows results 1163 for after 2 hours of immersion, results 1166 for after 6 hours of immersion, results 1168 for after 12 hours of immersion, and results 1172 for after 24 hours of immersion.

The impedance of pure bulk magnesium increased as a function of incubation time. This tendency was attributed to the generation of insoluble salt during the corrosion, which was previously observed in which EIS was conducted using bulk magnesium. The generated insoluble salt was adsorbed into the outer surface of the bulk magnesium, resulting in the retardation of corrosion. However, the impedance of the magnesium alloy foam was ten times lower than that of bulk magnesium, which is in good accordance with the results of PD analysis. Furthermore, there were no significant changes in the value of the impedance of the magnesium alloy foam as a function of incubation time. This difference in impedance behavior is attributed to the porous structure of the magnesium alloy foam and its enhanced surface area (about 13 times larger). The adsorption tendency of the insoluble salt into the outer surface of the bulk magnesium is unlikely to be effective for the magnesium alloy foam due to the much larger surface to be covered.

Summary

As an example, magnesium-aluminum alloy (AE42) foams were successfully synthesized and examined through a facile and novel invention based on camphene-based freeze casting and a controlled heat treatment process, overcoming the inherent difficulties of using magnesium as a starting powder in powder-based processes. The final porous morphology of the resulting foams is appropriate for biomedical, aerospace, metal-air electrode, and hydrogen storage applications:

The final microstructure of the magnesium alloy foam prepared using camphene-based freeze casting consisted of uniformly distributed small pores in the range of a few tens of microns with bead-shaped struts including occasional larger pores on the order of a couple hundred microns. XRD, SEM, and EDS analysis revealed that no notable compositional alteration and contamination occurred during the freeze casting synthesis.

The raw AE data stream was recorded and used for ASK analysis to confirm the mechanical reliability and the salient deformation mechanisms during the compressive test. Based on evaluation of the deformation mechanisms, the overall deformation behavior of the magnesium foam appeared quite similar to that of the bulk magnesium alloy. The plastic deformation of the magnesium foam appeared to be the governing deformation mechanism. Based on the ASK analysis results, twinning, dislocation slip, and strut bending and collapsing mechanisms were consecutively or simultaneously (over some intervals) identified and compared in terms of their energy and frequency range.

The corrosion potential of the magnesium alloy foam (−1.442 volts) was slightly higher than that of pure bulk magnesium (−1.563 volts) owing to the inherent benefits of alloying, which is in agreement with expectations on the enhanced in-vivo corrosion resistance of magnesium alloys compared to pure magnesium. However, the corrosion rate of the magnesium alloy foam was faster than that of bulk pure magnesium due to the enhanced surface area of the foam compared with pure magnesium. On the other hand, the impedance of the magnesium alloy foam was ten times lower than that of bulk magnesium, in accordance with the results of PD analysis. Furthermore, there were no significant changes in the value of impedance for the magnesium alloy foam as a function of incubation time.

In an implementation, a composition of matter includes a three dimensionally connected magnesium or magnesium alloy foams of at least one of Mg—Al, Mg—Zn, Mg—Al, Mg—Mn, Mg—Si, Mg—Cu, Mg—Zr, or Mg-rare earth elements, or any combination of these. The foam's pore structure can have a porosity of from about 45 percent to about 85 percent with an open pore structure. The magnesium or magnesium alloy green-body foam has a two-step sintering process consisting of (i) burning of chemical additives (binder and dispersant) at about 300-450 degrees Celsius for about 3-5 hours and (ii) sintering of magnesium or magnesium alloy green-body foam at 500-650 degrees Celsius for about 3-10 hours in argon atmosphere.

In an implementation, a method or process includes:

(i) mixing magnesium or magnesium alloy powder and suspending in a solution of liquid camphene containing about 3-6 weight-percent binder and about 1-3 weight-percent dispersant;

(ii) stirring or sonicating the suspension solution uniformly in warm-water bath for about 30-60 minutes;

(iii) freeze casting the camphene-based magnesium or magnesium alloy powder slurry solution;

(iv) drying (e.g., sublimation) camphene by placing the frozen green-body foam in an air hood for about 3-7 days or in freeze dryer for about 24-48 hours; and (v) after sintering, producing a three dimensionally connected magnesium or magnesium alloy foam of at least one of Mg—Al, Mg—Zn, Mg—Al, Mg—Mn, Mg—Si, Mg—Cu, Mg—Zr, or Mg-rare earth element, or any combination.

In the process, the magnesium or magnesium alloy powder can have an average size of about 1 microns to about 100 microns. The magnesium or magnesium alloy powder can be mixed and suspended in camphene or other liquid solvent such as cyclohexane, dioxane, tert-butyl alcohol, or dimethyl sulfoxide (excluding water due to oxidation) with a binder and a dispersant. The binder can be a polystyrene and the dispersant can be a oligometric polyester powder.

The method can include mechanically mixing the magnesium alloy powders, if it is not prealloyed (e.g., for from about 10 minutes to about 60 minutes) to obtain a uniform particle mixing before mixing with water, binder, and dispersant. The method can include freezing the slurry at a temperature from about −80-40 degrees Celsius using liquid nitrogen to room temperature. The method can include drying the frozen slurry solution at a temperature from about −80 degrees Celsius in vacuum to about room temperature to obtain a green-body foam.

The method can include sintering the magnesium or magnesium alloy green-body foam contained in an alumina crucible filled with graphite powder (e.g., mean particle size about 1-30 microns) to improve sinterability, thereby transforming the foam green body to the magnesium or magnesium alloy with the same composition. The magnesium or magnesium alloy foam can having a three-dimensional pore structure with uniformly distributed pores having diameters from about 1 micron to about 300 microns.

This description of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications. This description will enable others skilled in the art to best utilize and practice the invention in various embodiments and with various modifications as are suited to a particular use. The scope of the invention is defined by the following claims.

This invention claimed is:

1. A method comprising:

mixing magnesium or magnesium alloy powder having a particle size from about 36 microns to 45 microns in a solution of camphene to obtain a suspension solution containing about 3-6 weight-percent binder and about 1-3 weight-percent dispersant;

stirring or sonicating the suspension solution uniformly in water bath for about 30-60 minutes to obtain a slurry solution;

freeze casting the camphene-based magnesium or magnesium alloy powder slurry solution;

drying, via sublimation, camphene, a frozen green-body foam, by placing the frozen green-body foam in an air hood for about 3-7 days or in a freeze dryer for about 24-48 hours; and after drying, sintering the frozen green-body foam comprising the magnesium or magnesium alloy, wherein the sintering comprises a two-step sintering process comprising burning of the binder and dispersant at about 300-450 degrees Celsius for about 3-5 hours, and sintering of the frozen green-body foam at about 500-650 degrees Celsius for about 3-10 hours in argon atmosphere, and after sintering, a three dimensionally connected magnesium or magnesium alloy foam is produced of at least one of Mg—Al, Mg—Zn, Mg—Al, Mg—Mn, Mg—Si, Mg—Cu, Mg—Zr, or Mg-rare earth element, or any combination thereof.

2. The method of claim 1 wherein the binder is polystyrene and the dispersant is oligometric polyester powder.

3. The method of claim 1 comprising:

mechanically mixing powders of the magnesium and another element for from about 10 minutes to about 60 minutes to obtain a uniform particle mixing before mixing with liquid caphene, binder, and dispersant when the powders used are not prealloyed.

4. The method of claim 1 comprising:

freezing the slurry solution at a temperature from about −80-40 degrees Celsius.

5. The method of claim 1 comprising:

drying the slurry solution in a vacuum at a temperature from about −80 degrees Celsius to about room temperature.

6. The method of claim 1 comprising:

sintering the frozen green-body foam in an alumina crucible filled with graphite powder having a mean particle size of about 1-30 microns, thereby transforming the frozen green-body foam to the magnesium or magnesium alloy foam.

7. The method of claim 6 wherein the magnesium or magnesium alloy foam comprises a three-dimensional pore structure with uniformly distributed pores having diameters from about 1 micron to about 300 microns.

8. A method comprising:

mixing a magnesium alloy powder having a particle size from about 36 microns to 45 microns in a solution of camphene to obtain a suspension solution containing about 3-6 weight-percent binder comprising polystyrene and about 1-3 weight-percent dispersant comprising oligometric polyester powder;

stirring or sonicating the suspension solution uniformly in a water bath for about 30-60 minutes to obtain a slurry solution;

freeze casting the camphene-based magnesium alloy powder slurry solution;

drying camphene, a frozen green-body foam, by placing the frozen green-body foam in an air hood for about 3-7 days or in a freeze dryer for about 24-48 hours; and after drying, sintering the frozen green-body foam comprising the magnesium alloy, wherein the sintering comprises a two-step sintering process comprising burning of the binder and dispersant at about 300-450 degrees Celsius for about 3-5 hours, and sintering of the frozen green-body foam at about 500-650 degrees Celsius for about 3-10 hours in argon atmosphere, and after sintering, a three dimensionally connected magnesium alloy foam is produced of at least one of Mg—Al, Mg—Zn, Mg—Al, Mg—Mn, Mg—Si, Mg—Cu, Mg—Zr, or Mg-rare earth element, or any combination thereof.

9. A method comprising:

(i) mixing magnesium or magnesium alloy powder in a solution of liquid camphene to obtain a suspension solution containing about 3-6 weight-percent binder comprising polystyrene and about 1-3 weight-percent dispersant;

(ii) stirring or sonicating the suspension solution uniformly in warm-water bath at above degrees Celsius for about 30-60 minutes to obtain a slurry solution;

(iii) freeze casting the camphene-based magnesium or magnesium alloy powder slurry solution;

(iv) drying, via sublimation, camphene, a frozen green-body foam, by placing the frozen green-body foam in an air hood for about 3-7 days or in a freeze dryer for about 24-48 hours; and (v) after drying, sintering the frozen green-body foam comprising the magnesium or magnesium alloy, and after sintering, a three dimensionally connected magnesium or magnesium alloy foam is produced of at least one of Mg—Al, Mg—Zn, Mg—Al, Mg—Mn, Mg—Si, Mg—Cu, Mg—Zr, or Mg-rare earth element, or any combination thereof, wherein the sintering the frozen green-body foam comprising the magnesium or magnesium alloy comprises a two-step sintering process comprising burning of the binder and dispersant at about 300-450 degrees Celsius for about 3-5 hours, and sintering of the frozen green-body foam at about 500-650 degrees Celsius for about 3-10 hours in argon atmosphere.

* * * * *